US011105519B2

(12) United States Patent
Luo et al.

(10) Patent No.: US 11,105,519 B2
(45) Date of Patent: Aug. 31, 2021

(54) AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Wenjun Luo, Foshan (CN); Zhicai Cai, Foshan (CN); Kuifang Zou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 30 days.

(21) Appl. No.: 16/498,582

(22) PCT Filed: Aug. 30, 2019

(86) PCT No.: PCT/CN2019/103825
§ 371 (c)(1),
(2) Date: Sep. 27, 2019

(87) PCT Pub. No.: WO2021/003829
PCT Pub. Date: Jan. 14, 2021

(65) Prior Publication Data

US 2021/0010691 A1 Jan. 14, 2021

(30) Foreign Application Priority Data

Jul. 8, 2019 (CN) ..... 201921058404.0
Jul. 8, 2019 (CN) ..... 201921063126.8

(51) Int. Cl.
*F24F 1/0314* (2019.01)

(52) U.S. Cl.
CPC ..... *F24F 1/0314* (2019.02)

(58) Field of Classification Search
CPC ..... F24F 1/0314; F24F 1/0007; F24F 1/027; F24F 1/0057; F24F 1/00; F24F 1/24; F24F 11/89; F24F 13/20; H05K 7/02
See application file for complete search history.

(56) References Cited

U.S. PATENT DOCUMENTS

2017/0268789 A1 9/2017 Liu et al.

FOREIGN PATENT DOCUMENTS

CN 204634200 U * 9/2015
CN 204634200 U 9/2015
CN 207763061 U 8/2018
(Continued)

OTHER PUBLICATIONS

World Intellectual Property Organization (WIPO) International Search Report and Written Opinion for PCT/CN2019/103825 dated Apr. 1, 2020 17 Pages.

(Continued)

*Primary Examiner* — Emmanuel E Duke
(74) *Attorney, Agent, or Firm* — Anova Law Group PLLC

(57) ABSTRACT

An air conditioner includes a chassis, a face frame over the chassis, an electric control box mounted at the face frame and located at a front portion of the face frame, and a panel configured to openably cover the front portion of the face frame and the electric control box. At least a portion of the electric control box is detachably connected to the face frame.

20 Claims, 20 Drawing Sheets

(56) References Cited

FOREIGN PATENT DOCUMENTS

| | | | | |
|---|---|---|---|---|
| CN | 208059068 | U | * | 11/2018 |
| CN | 208059068 | U | | 11/2018 |
| CN | 208238044 | U | * | 12/2018 |
| CN | 208238044 | U | | 12/2018 |
| EP | 3187794 | A1 | | 7/2017 |
| EP | 3279574 | A1 | | 2/2018 |
| JP | 2011106753 | A | | 6/2011 |
| JP | 2013036671 | A | * | 2/2013 |
| JP | 2013036671 | A | | 2/2013 |
| JP | 2014070762 | A | | 4/2014 |
| WO | 2013108650 | A1 | | 7/2013 |

OTHER PUBLICATIONS

The European Patent Office (EPO) Extended Search Report for EP Application No. 19787130.4 dated Nov. 24, 2020 7 Pages.

Intellectual Property Office of Korea (IPKR) The Office Action For KR Application No. 10-2019-7028703 dated Mar. 16, 2021 13 Pages (Translation Included ).

* cited by examiner

AIR CONDITIONER

CROSS-REFERENCE TO RELATED APPLICATIONS

This application is a National Stage Entry under 35 U.S.C. § 371 of International Application No. PCT/CN2019/103825, filed on Aug. 30, 2019, which is based on and claims priority to Chinese Patent Application Serial No. 201921063126.8, filed on Jul. 8, 2019, and Chinese Patent Application Serial No. 201921058404.0, filed on Jul. 8, 2019, the entire contents of all of which are incorporated herein by reference.

FIELD

The present application relates to a technical field of air conditioning, and more particularly to an air conditioner.

BACKGROUND

In the related art, an electric control box is under a face frame. When mounting or maintenance operation of an electric control board is needed, a panel needs to be opened first, and then the face frame is removed, so as to operate the electric control box. In some models, the face frame includes a large opening at a right side thereof, and the electric control board can be removed through the opening. The large opening is closed with a cover plate, it is necessary to remove the cover plate first so as to operate the electric control box, resulting in relatively cumbersome operations.

SUMMARY

The present application seeks to solve at least one of the problems existing in the related art to at least some extent.

To this end, one objective of the present application is to propose an air conditioner, an electric control box of the air conditioner is easy to dismount and mount.

The air conditioner according to embodiments of the present application includes a chassis; a face frame covering on the chassis; an electric control box mounted at the face frame and located at a front portion of the face frame, at least a portion of the electric control box being detachably connected to the face frame; and a panel openably covering the front portion of the face frame, the electric control box facing the panel in a front-and-rear direction.

In the air conditioner according to embodiments of the present application, the electric control box is mounted at the front portion of the face frame, at least a portion of the electric control box is detachably connected to the face frame, and the panel faces the electric control box in the front-and-rear direction, thereby facilitating maintenance of the electric control box.

Additionally, the air conditioner according to embodiments of the present application may further have the following additional technical features.

According to an embodiment of the present application, an entirety of the electric control box is detachably mounted at the face frame.

According to an embodiment of the present application, an upper end of the electric control box is inserted into an upper side of the front portion of the face frame, and a lower end of the electric control box is provided with a first overlapping part overlapped at a front surface of a lower side of the front portion of the face frame, and the first overlapping part is detachably connected to the face frame.

According to an embodiment of the present application, the electric control box is disposed at least one end of the face frame in a left-and-right direction, the electric control box is provided with a second overlapping part overlapped at a front surface of the corresponding end of the face frame, and the second overlapping part is detachably connected to the face frame.

According to an embodiment of the present application, the front portion of the face frame has an opening part, and at least a portion of the electric control box is detachably disposed in the opening part.

According to an embodiment of the present application, the electric control box includes a box body and a box cover, the box body is internally formed with an accommodating cavity having an open front portion and adapted to position an electric control board, and the box cover openably covers an open side of the box body.

According to an embodiment of the present application, the box cover is turnably or detachably connected to the box body.

According to an embodiment of the present application, the box body comprises a first inner housing and a first sheet metal part, the first sheet metal part wraps an outer side of the first inner housing, and the first sheet metal part is undetachably or detachably connected to the first inner housing; or the box cover includes a second inner housing and a second sheet metal part, the second sheet metal part wraps an outer side of the second inner housing, and the second sheet metal part is undetachably or detachably connected to the second inner housing.

According to an embodiment of the present application, the face frame and the chassis are detachably connected.

According to an embodiment of the present application, the panel is rotatably or turnably connected to the face frame.

According to an embodiment of the present application, the face frame has an overlapping groove recessed rearwards; and the electric control box includes a wire passage part internally having a wire passage groove, the wire passage groove is in communication with an internal space of the electric control box, and the wire passage part is embedded in the overlapping groove.

According to an embodiment of the present application, the panel is hinged with the face frame.

According to another embodiment of the present application, the electric control box includes: a first inner housing having an opening and a first connection face; a second inner housing detachably connected to the first inner housing to open and close the opening, the second inner housing having the second connection face fitted to the first connection face, in which one of the first inner housing and the second inner housing has a water stop part extending into the other thereof, and the water stop part is located inside fitting place between the first connection face and the second connection face.

According to an embodiment of the present application, the second inner housing has a flange part extending towards the first inner housing, and the water stop part is disposed on an inner side of the flange part and the water stop part and the flange part are oppositely arranged.

According to an embodiment of the present application, an end face of the flange part forms the second connection face.

According to an embodiment of the present application, the water stop part is arranged adjacent to the opening, and the first connection face is disposed outside the water stop part and lower than an end face of the water stop part.

According to an embodiment of the present application, the flange part and the water stop part are spaced apart from each other.

According to an embodiment of the present application, a length of an overlapping portion between the flange part and the water stop part is greater than or equal to 1 millimeter in an extending direction of the flange part.

According to an embodiment of the present application, the water stop part is oriented in an extending direction of an edge of the opening.

According to an embodiment of the present application, the electric control box further includes a first sheet metal part covering an outer side of the first inner housing and connected to the first inner housing; a second sheet metal part covering an outer side of the second inner housing and connected to the second inner housing, in which the second sheet metal part has a blocking part extending towards the first sheet metal part, and the blocking part extends beyond fitting place between the first connection face and the second connection face.

According to an embodiment of the present application, the first inner housing is fitted to the first sheet metal part by snap-fit; and/or the second inner housing is fitted to the second sheet metal part by snap-fit.

According to an embodiment of the present application, one of the first inner housing and the first sheet metal part has a first snap, and the other thereof has a first snap hole fitted to the first snap; and/or one of the second inner housing and the second sheet metal part has a second snap, and the other thereof has a second snap hole fitted to the second snap.

According to an embodiment of the present application, one of the first inner housing and the first sheet metal part has a first insertion groove, and the other thereof has a first insertion part fitted to the first insertion groove to cause the first sheet metal part to be in tight contact with the first inner housing; and/or one of the second inner housing and the second sheet metal part has a second insertion groove, and the other thereof has a second insertion part fitted to the second insertion groove to cause the second sheet metal part to be in tight contact with the second inner housing.

According to an embodiment of the present application, the air conditioner includes a housing internally provided with a mounting cavity; an indoor heat exchanger disposed in the mounting cavity; an indoor fan disposed in the mounting cavity; and an electric control box according to the above-described embodiments, the electric control box being disposed in the mounting cavity and located at a shaft side of the indoor fan.

According to an embodiment of the present application, the electric control box is located at a side of the indoor heat exchanger, and a side of the electric control box near the indoor heat exchanger matches a shape of the indoor heat exchanger.

Additional aspects and advantages of the present application will be given in part in the following descriptions, become apparent in part from the following descriptions, or be learned from the practice of the present application.

BRIEF DESCRIPTION OF THE DRAWINGS

These and other aspects and advantages of embodiments of the present application will become apparent and more readily appreciated from the following descriptions made with reference to the drawings, in which.

Figure 1:
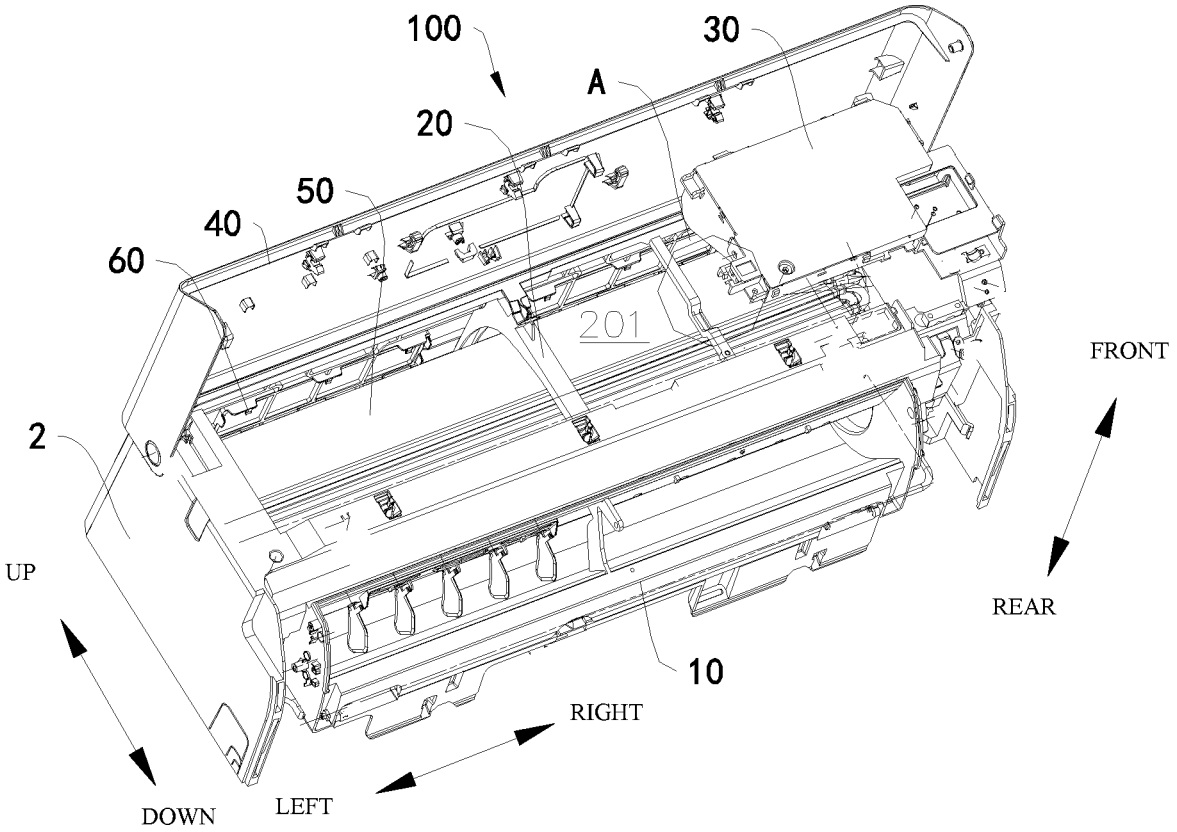
FIG. 1 is a perspective view of an air conditioner according to an embodiment of the present application.

Reference numerals: air conditioner 100; chassis 10; face frame 20; opening part 201; insertion hole 21; limiting part 22; support beam 23; overlapping groove 231; electric control box 30; hook 31; first overlapping part 32; second overlapping part 33; box body 34; first inner housing 341; first sheet metal part 342; box cover 35; second inner housing 351; second sheet metal part 352; electric control board 36; wire passage part 37; wire passage groove 371; rib 372; screw column 38; screw hole 39; panel 40; indoor heat exchanger 50; air-inlet grille 60; passage opening 101; second snap protrusion 111; second flange 112; insertion groove 113; second guide face 114; fixing sheet 115; first snap hole 117; first insertion part 118, first snap protrusion 121; first flange 122; insertion projection 123; first guide face 124; handle 125; second snap hole 126; blocking part 130; body part 200; opening 202; isolation gap 203; sub-zone 204; first snap 211; first connection face 212; first insertion groove 213; isolation rib 214; second snap 221; second connection face 223; flange part 224; water stop part 230; housing 2.

DETAILED DESCRIPTION

Embodiments of the present application will be described in detail and examples of the embodiments will be illustrated in the drawings, where same or similar reference numerals are used to indicate same or similar members or members with same or similar functions. The embodiments described herein with reference to drawings are explanatory, illustrative, and intended to generally understand the present application. The embodiments shall not be construed to limit the present application.

In the following, an air conditioner 100 according to embodiments of the present application will be described with reference to FIGS. 1 to 13.

An up-and-down direction, a left-and-right direction, and a front-and-rear direction recited in the present application are as illustrated in FIGS. 1, 3, 4, 6 and 9. It should be understood that, terms such as "left", "right", "front", "rear", "upper" and "lower" as well as derivative thereof should be construed to refer to the orientation as then described or as shown in the drawings under discussion. These relative terms are for convenience of description and do not require that the present application be constructed or operated in a particular orientation.

Figure 3:
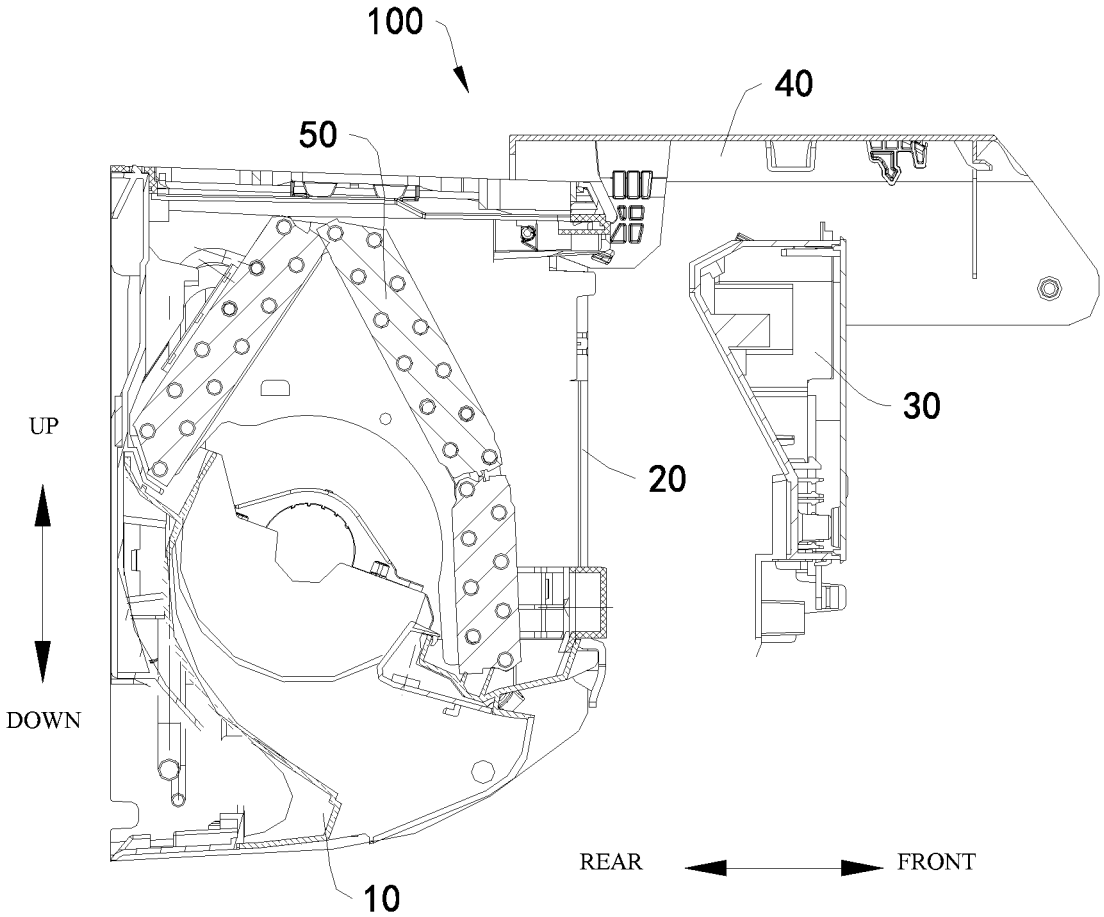
FIG. 3 is a schematic view of a structure of an air conditioner according to an embodiment of the present application.
Figure 4:
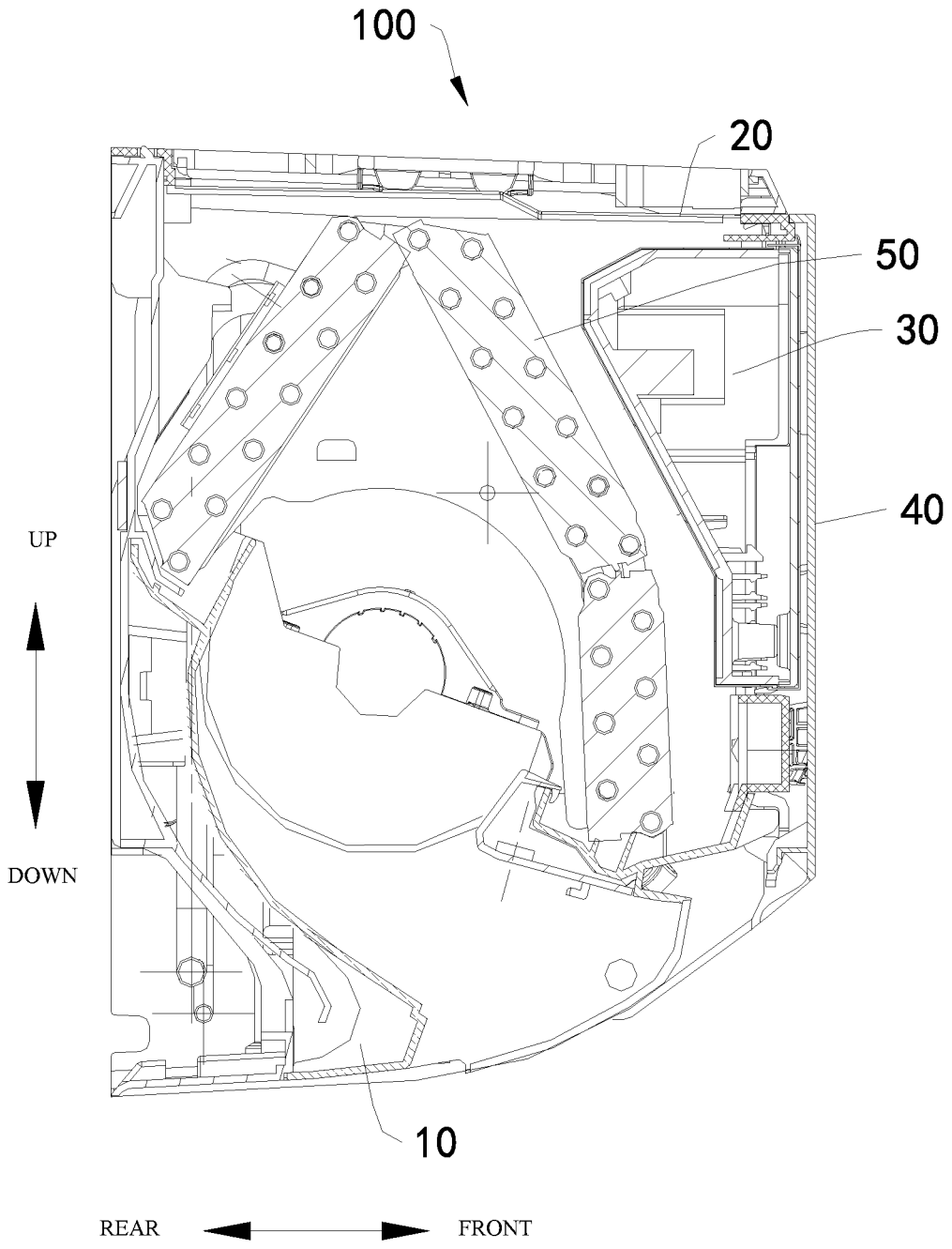
FIG. 4 is a schematic view of a structure of an air conditioner according to an embodiment of the present application.

As illustrated in FIGS. 1, 3 and 4, the air conditioner 100 may generally include a chassis 10, a face frame 20, an electric control box 30 and a panel 40.

Specifically, as illustrated in FIGS. 3 and 4, the face frame 20 covers on the chassis 10, and the electric control box 30 is mounted at the face frame 20 and located at a front portion of the face frame 20. The electric control box 30 is mounted at the front portion of the face frame 20, such that the electric control box 30 can be maintained, dismounted and mounted directly from the front portion of the face frame 20 during maintenance, thereby reducing probability of interference of the face frame 20 to an operator, and improving maintenance efficiency.

Additionally, at least a portion of the electric control box 30 is detachably connected to the face frame 20. An entirety of the electric control box 30 may be detachably connected to the face frame 20. In this way, the entirety of the electric control box 30 can be dismounted when maintenance of the electric control box 30 is needed. It could be understood that, an indoor unit for the air conditioner 100, in particular a wall-mounted indoor unit for the air conditioner 100, generally has a high mounting position, which brings trouble to the maintenance of the electric control box 30. The electric control box 30 may be entirely dismounted and mounted, such that the entirety of the electric control box can be removed by the operator, and the electric control box 30 can be maintained on the ground, thereby facilitating the maintenance. Alternatively, a portion of the electric control box 30 is detachably connected to the face frame 20. In this way, after completion of the maintenance, just the detached portion needs to be remounted, thereby reducing mounting steps. For example, a side of the electric control box 30 opposite the panel 40 is detachable.

As illustrated in FIGS. 1, 3 and 4, the panel 40 openably covers the front portion of the face frame 20, and the electric control box 30 faces the panel 40 in the front-and-rear direction. In this way, when maintenance of the electric control box 30 is needed, just the panel 40 needs to be opened, the operator can directly maintain the electric control box 30, thereby further facilitating the maintenance.

Thus, in the air conditioner 100 according to embodiments of the present application, the electric control box 30 is mounted at the front portion of the face frame 20, at least a portion of the electric control box 30 is detachably connected to the face frame 20, and the electric control box 30 faces the panel 40 in the front-and-rear direction, thereby improving convenience of the electric control box 30 and facilitating maintenance, mounting and dismounting of the electric control box 30.

In some embodiments, the entirety of the electric control box 30 is detachably mounted at the face frame 20. Certainly, the above-described embodiments are merely illustrative, and cannot be construed to limit protection scope of the present application. For example, the electric control box 30 may also be partially and detachably connected to the face frame 20. Certainly, the electric control box 30 may have a portion detachably connected to the face frame 20, while its entirety is detachably connected to the face frame 20. By taking the latter as an example, the operator can choose to entirely or partially remove the electric control box 30 according to actual situation, thereby increasing selectivity for the operator and facilitating improvement of the maintenance efficiency.

Figure 5:
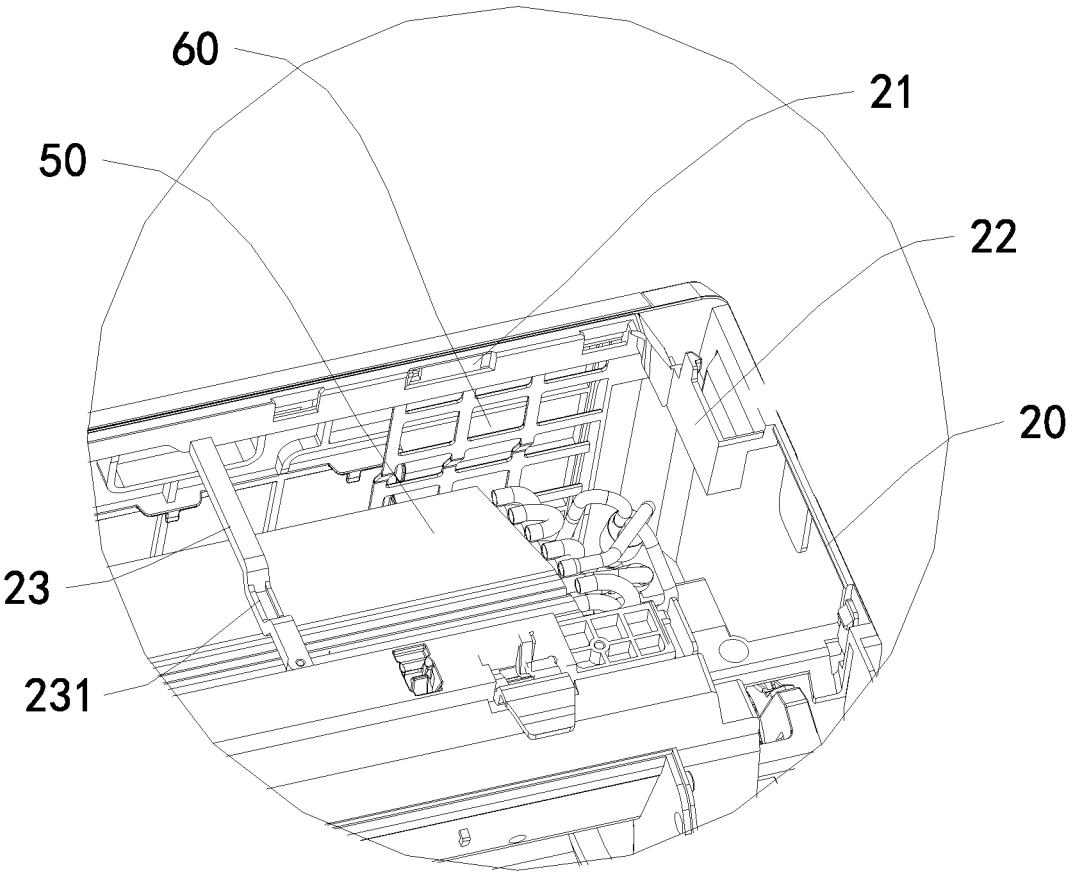
FIG. 5 is a schematic view of a partial structure of an air conditioner according to an embodiment of the present application.
Figure 7:
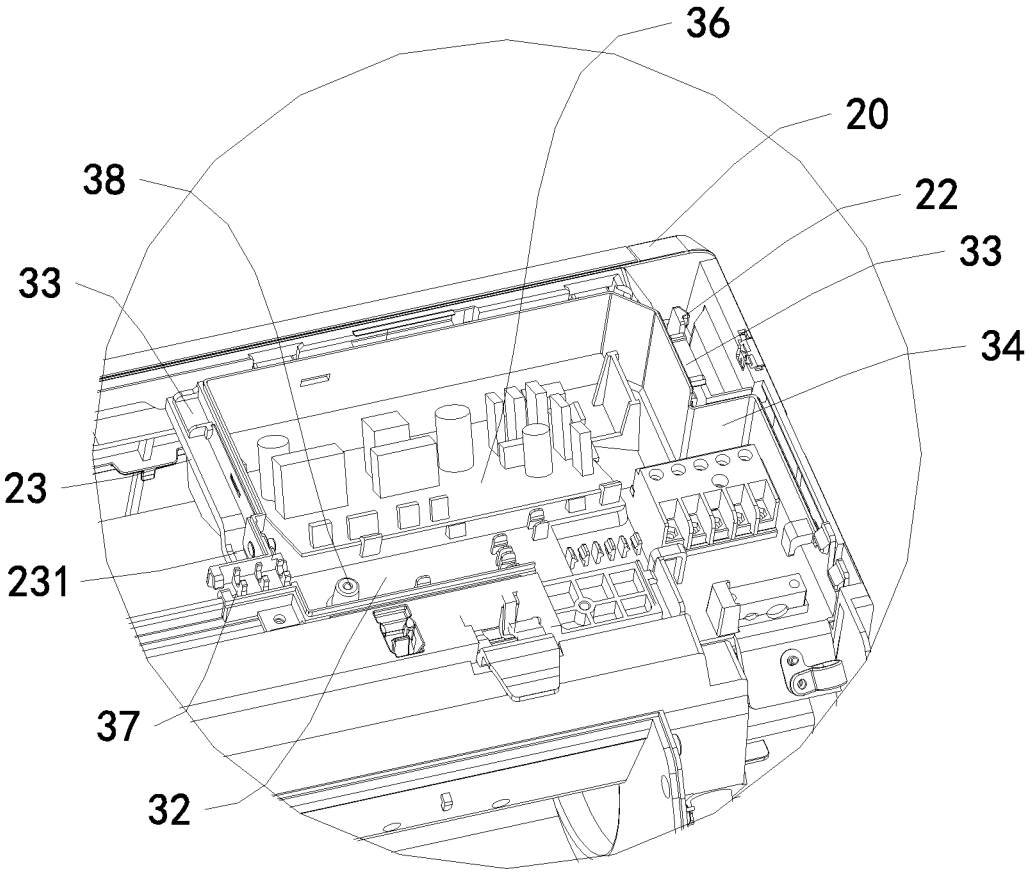
FIG. 7 is a schematic view showing connection relationship between an electric control box and a face frame according to an embodiment of the present application.
Figure 11:
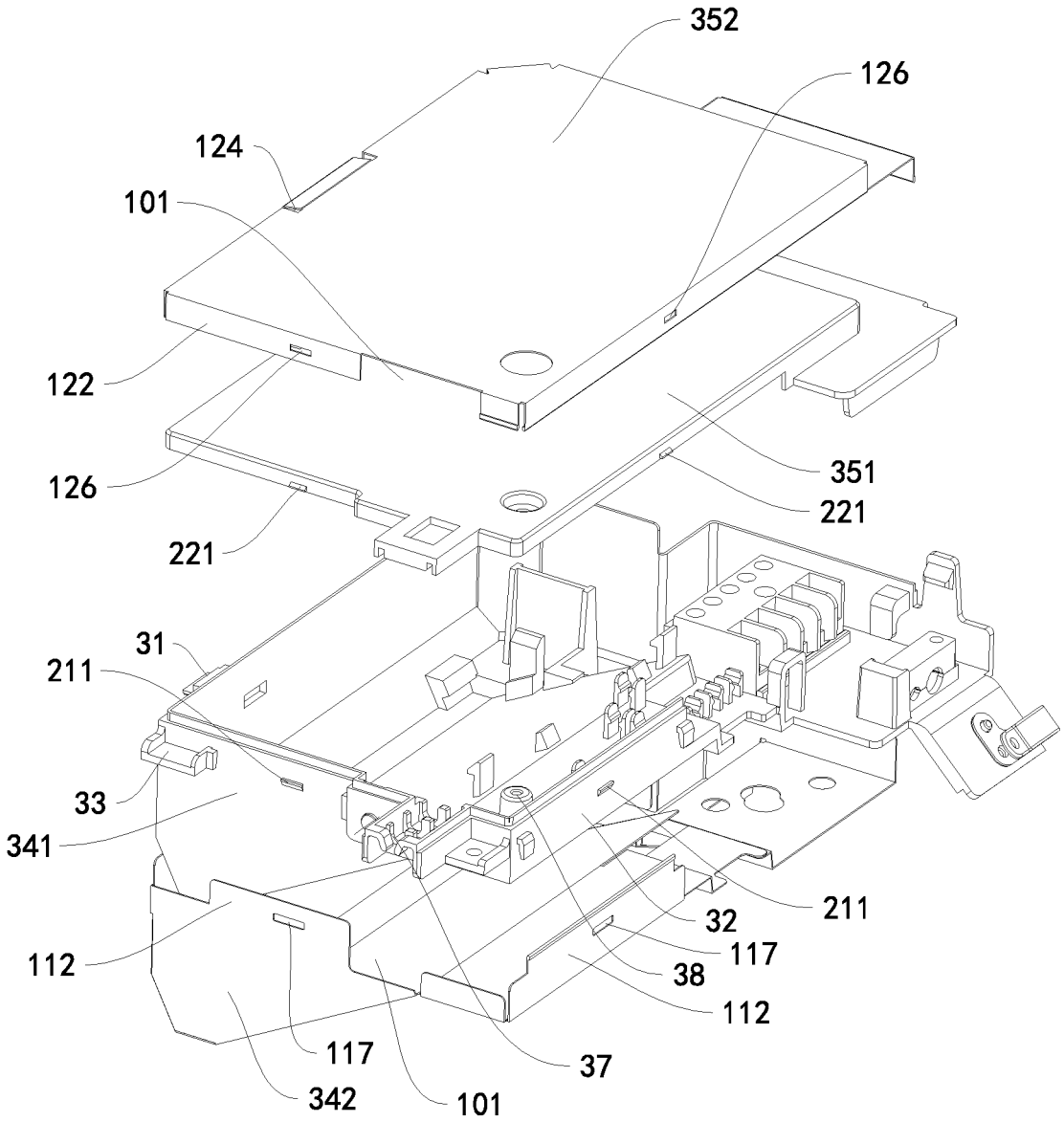
FIG. 11 is an exploded view of an electric control box according to an embodiment of the present application.

In some optional embodiments, as illustrated in FIGS. 5, 7 and 11, an upper end of the electric control box 30 is inserted to an upper side of the front portion of the face frame 20, a lower end of the electric control box 30 is provided with a first overlapping part 32 overlapped at a front surface of a lower side of the front portion of the face frame 20, and the first overlapping part 32 is detachably connected to the face frame 20. Thus, the first overlapping part 32 at a lower side of the electric control box 30 is overlapped at the front surface of the face frame 20, and the upper end of the electric control box 30 is inserted to the upper side of the front portion of the face frame 20, and the electric control box 30 is mounted and secured to the face frame 20. The upper end of the electric control box 30 may be provided with an insertion hole 21, the face frame 20 is provided with a hook 31 corresponding to the insertion hole 21, and the hook 31 extends into the insertion hole 21 and hooks the electric control box 30. Alternatively, the upper end of the electric control box 30 is provided with the hook 31, the face frame 20 is provided with the insertion hole 21 corresponding to the hook 31, and the hook 31 extends into the insertion hole 21 and hooks the face frame 20. Furthermore, a plurality of hooks 31 are provided and spaced apart from one another in the left-and-right direction. Thus, mounting stability of the electric control box 30 can be improved. Preferably, a side of the hook 31 facing the insertion hole 21 is provided with a guide slope. Thus, the hook 31 can easily extend into the insertion hole 21 and hook the face frame 20 or the electric control box 30. Additionally, it could be understood that, the first overlapping part 32 is detachably connected to the face frame 20, and the upper end of the electric control box 30 is inserted to the upper side of the front portion of the face frame 20, thus, the detachable connection between the entirety of the electric control box 30 and the face frame 20 can be realized. For example, the first overlapping part 32 may be screwed, snapped or inserted into the face frame 20.

Certainly, the above-described embodiments are merely illustrative, and cannot be construed to limit protection scope of the present application. For example, the upper end of the electric control box 30 may also be screwed to the upper side of the front portion of the face frame 20.

In some optional embodiments, as illustrated in FIGS. 1, 6, 7 and 8, the electric control box 30 is disposed at least one end of the face frame 20 in the left-and-right direction, the electric control box 30 is provided with a second overlapping part 33 overlapped at the corresponding end of the face frame 20, and the second overlapping part 33 is detachably connected to the face frame 20. For instance, the electric control box 30 is disposed at a right end of the face frame 20, and a right end of the electric control box 30 is provided with the second overlapping part 33, the second overlapping part 33 is overlapped at the face frame 20, and the second overlapping part 33 is detachably connected to the face frame 20. Thus, the face frame 20 can position the right end of the electric control box 30. The second overlapping part 33 is detachably connected to the face frame 20, and the second overlapping part 33 may be screwed, snapped, or inserted into the face frame 20. For instance, the second overlapping part 33 extends rightwards, the face frame 20 is provided with a limiting part 22, the limiting part 22 is provided with a limiting groove that opens leftwards, and the second overlapping part 33 is adapted to extend into the limiting groove. Certainly, the electric control box 30 may also be disposed at a left end of the face frame 20, which is not elaborated herein.

In some embodiments, as illustrated in FIG. 1, the front portion of the face frame 20 has an opening part 201, and at least a portion of the electric control box 30 is detachably disposed in the opening part 201. The at least a portion of the electric control box 30 is detachably disposed in the opening part 201, that is, the electric control box 30 is entirely or partially detachable. By providing the opening part 201, on the one hand, a mounting space can be provided for the electric control box 30, and a thickness of a machine body can be reduced; on the other hand, material used for the face frame 20 may be decreased, thereby facilitating cost saving.

In some embodiments, as illustrated in FIGS. 9, 10, 11, and 12, the electric control box 30 includes a box body 34 and a box cover 35. The box body 34 is internally formed with an accommodating cavity having an open front portion and adapted to position an electric control board 36, and the box cover 35 openably covers an open side of the box body 34. In this way, when maintenance of the electric control box 30 is needed, the entirety of the electric control box 30 is removed from the face frame 20, then the box cover 35 is opened, and the electric control board 36 can be maintained; or, the panel 40 is opened, the accommodating cavity opens forwards when the box cover 35 is opened because the electric control box 30 and the panel 40 face each other, thus the electric control board 36 is exposed, the operator can directly maintain the electric control board 36, and just close the box cover 35 and the panel 40 after completion of the maintenance, resulting in reduced steps and an improved maintenance efficiency.

In some optional embodiments, the box cover 35 is turnably or detachably connected to the box body 34. In the form in which the box cover 35 is arranged to be turnably connected to the box body 34, the box body 34 can be opened just by turning the box cover 35, and the box body 34 can be closed just by turning the box cover 35 again after the completion of the maintenance, resulting in a simple operation and a convenient maintenance. In the form in which the box cover 35 is arranged to be detachably connected to the box body 34, the box cover 35 is removed from the box body 34, and the box cover 35 is mounted at the box body 34 after completion of maintenance to close the accommodating cavity. The box cover 35 and the box body 34 can be connected by snap-fit, screw connection, etc.

Figure 9:
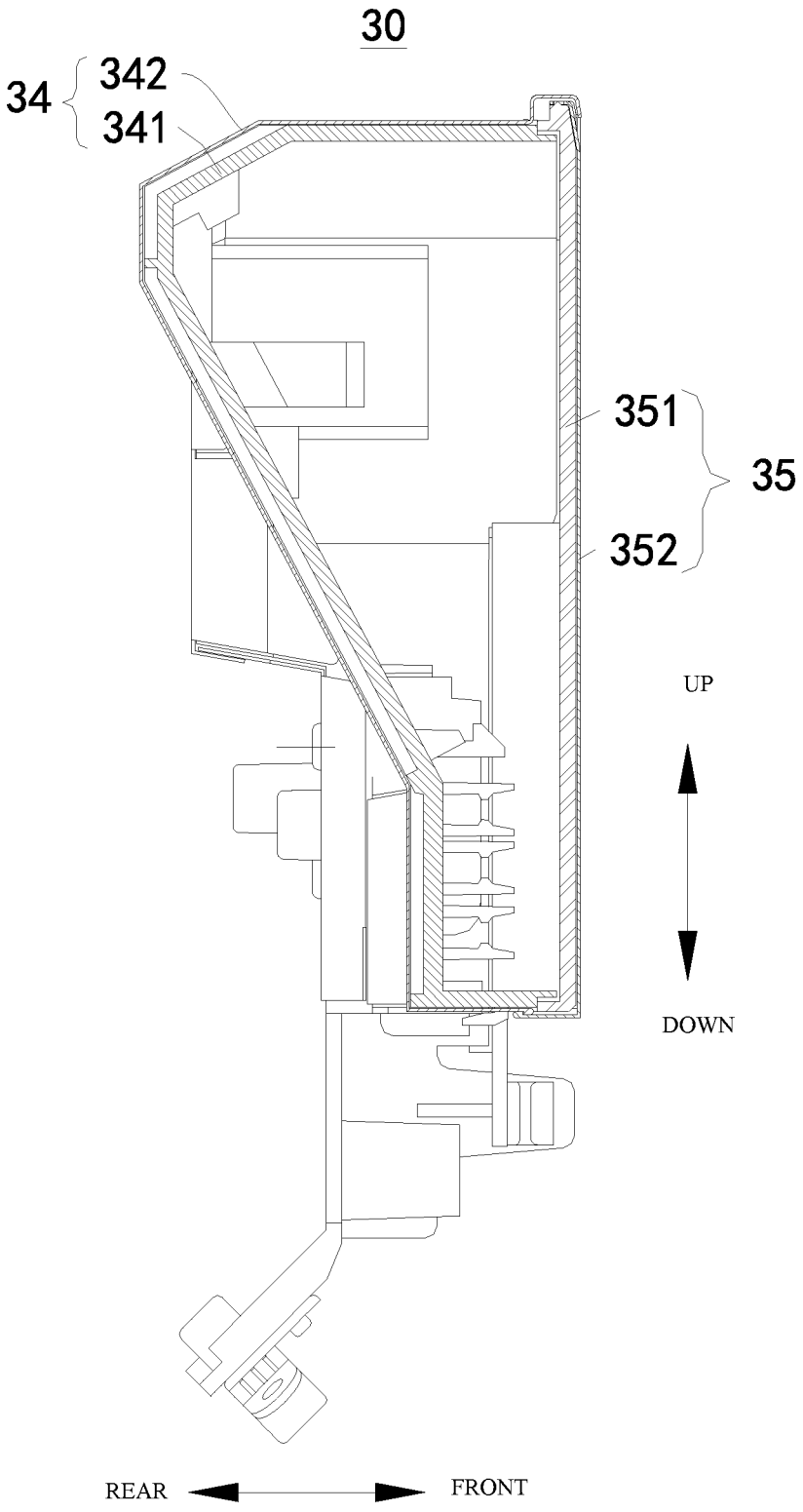
FIG. 9 is a schematic view of a structure of an electric control box according to an embodiment of the present application.
Figure 10:
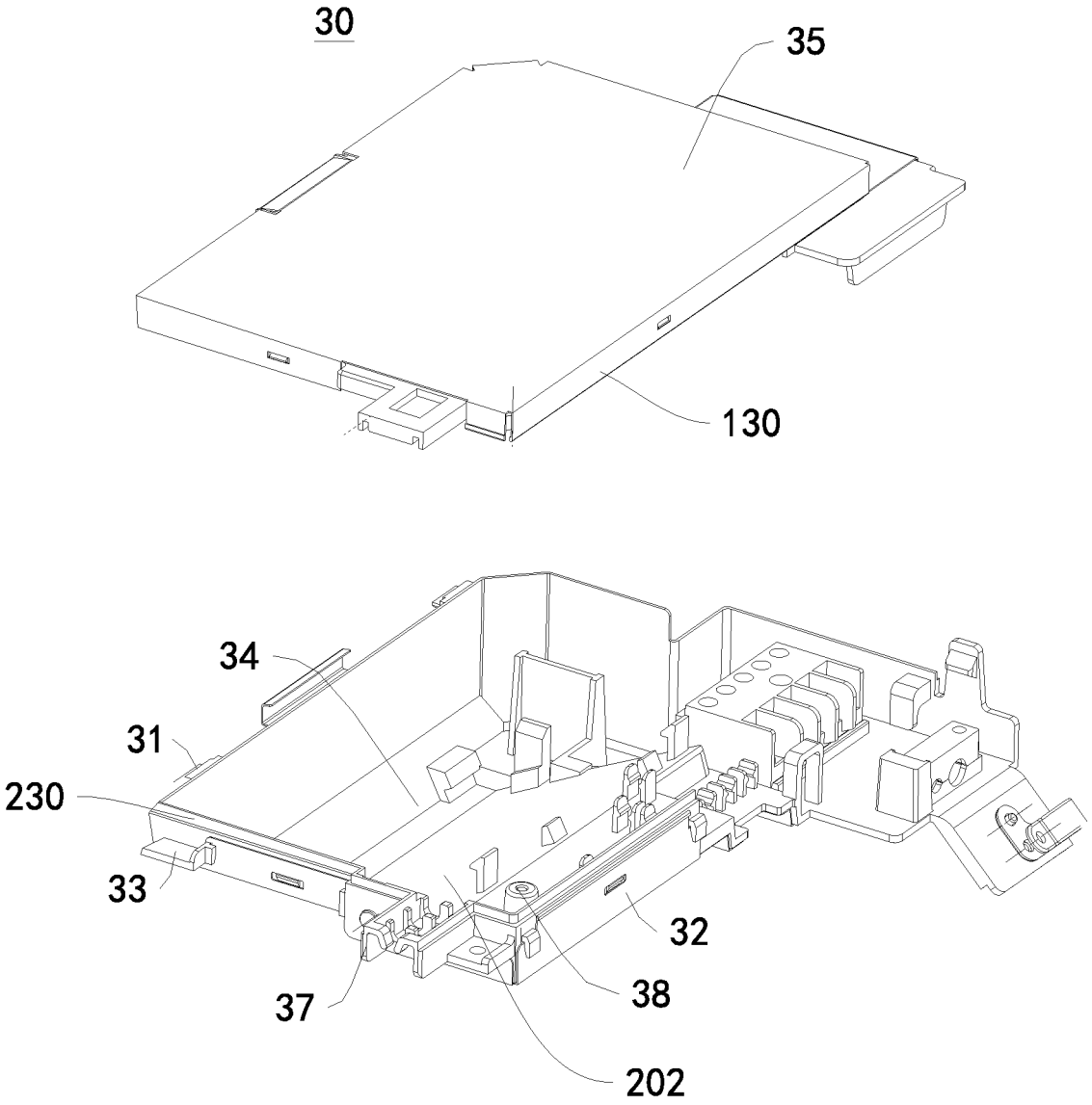
FIG. 10 is an exploded view of an electric control box according to an embodiment of the present application.

In some embodiments, as illustrated in FIG. 11, the box body 34 includes a first inner housing 341 and a first sheet metal part 342. The first sheet metal part 342 wraps an outer side of the first inner housing 341, and the first sheet metal part 342 is undetachably or detachably connected to the first inner housing 341. It could be understood that, the electric control box 30 is arranged near an indoor heat exchanger 50, the electric control box 30 may internally produce condensation water when the indoor heat exchanger 50 refrigerates. In the present application, the box body 34 includes the first inner housing 341 and the first sheet metal part 342, the first inner housing 341 and the first sheet metal part 342 have a gap therebetween, as illustrated in FIG. 9, so as to add an air layer to prevent the electric control box 30 from producing condensation water internally. The air layer may be a cavity, and may also be provided with a thermally insulative medium. Thus, the probability of producing the condensation water inside the electric control box 30 can be reduced, and safety performance of the electric control box 30 can be improved.

In some embodiments, as illustrated in FIG. 11, the box cover 35 includes a second inner housing 351 and a second sheet metal part 352. The second sheet metal part 352 wraps an outer side of the second inner housing 351, and the second sheet metal part 352 is undetachably or detachably connected to the second inner housing 351. It could be understood that, the electric control box 30 is arranged near the indoor heat exchanger 50, the electric control box 30 may internally produce condensation water when the indoor heat exchanger 50 refrigerates. In the present application, the box cover 35 includes the second inner housing 351 and the second sheet metal part 352, the second inner housing 351 and the second sheet metal part 352 have a gap therebetween, so as to add an air layer to prevent the electric control box 30 from producing condensation water internally. The air layer may be a cavity, and may also be provided with a thermally insulative medium. Thus, the probability of producing the condensation water inside the electric control box 30 can be reduced, and safety performance of the electric control box 30 can be improved.

In some embodiments, the face frame 20 is detachably connected to the chassis 10. Thus, when the maintenance of the chassis 10 is needed, the chassis 10 is removed from the face frame 20, and the operator can operate the chassis 10 on the ground, facilitating the maintenance. For instance, the face frame 20 is provided with a maintenance opening that opens forwards, the chassis 10 can extend into and withdraw from the maintenance opening, and the face frame 20 and the chassis 10 are connected by snap-fit.

In some optional embodiments, as illustrated in FIGS. 1, 3 and 4, the panel 40 is rotatably or turnably connected to the face frame 20. In the form in which the panel 40 is arranged to be turnably connected to the face frame 20, the face frame 20 can be opened just by turning the panel 40, and the face frame 20 can be closed just by turning the panel 40 again after the completion of the maintenance, resulting in a simple operation and a convenient maintenance. In the form in which the face frame 20 is arranged to be detachably connected to the panel 40, the panel 40 is removed from the face frame 20, and the panel 40 is mounted at the face frame 20 after completion of maintenance to close the face frame 20. The panel 40 and the face frame 20 can be connected by snap-fit, screw connection, etc.

Figure 2:
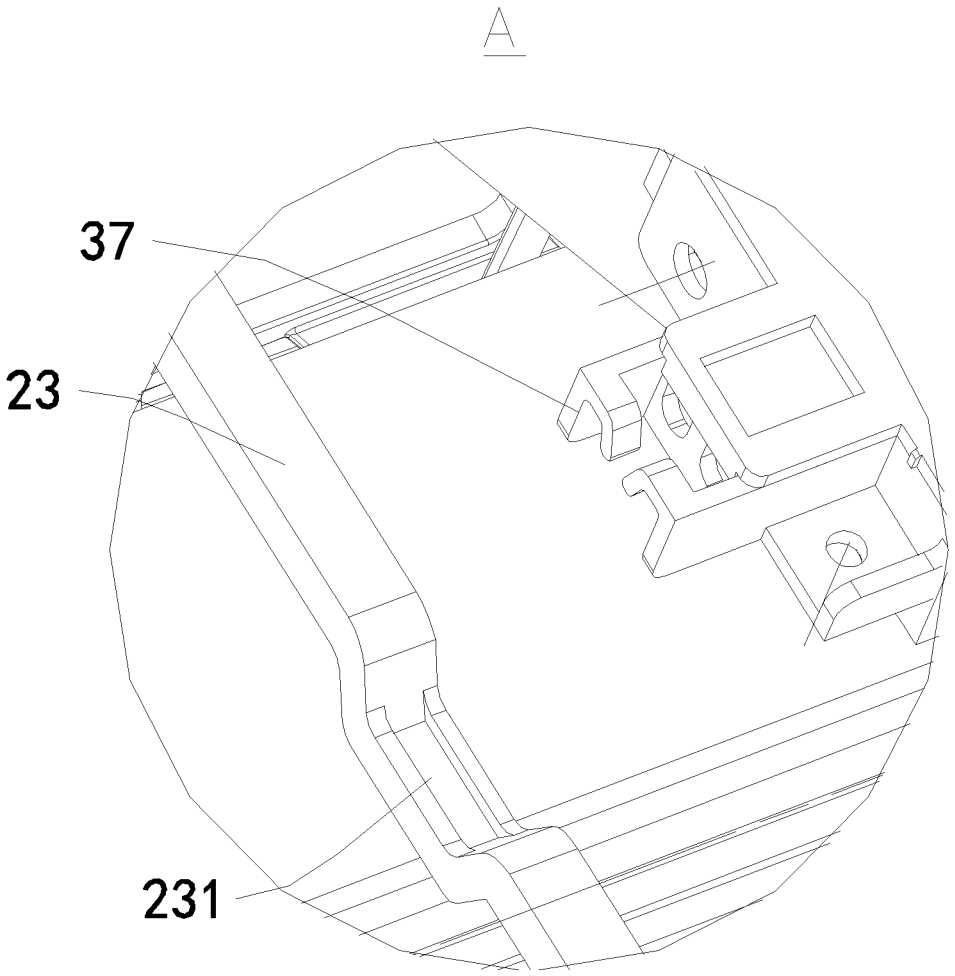
FIG. 2 is an enlarged view of a part A in FIG. 1.
Figure 8:
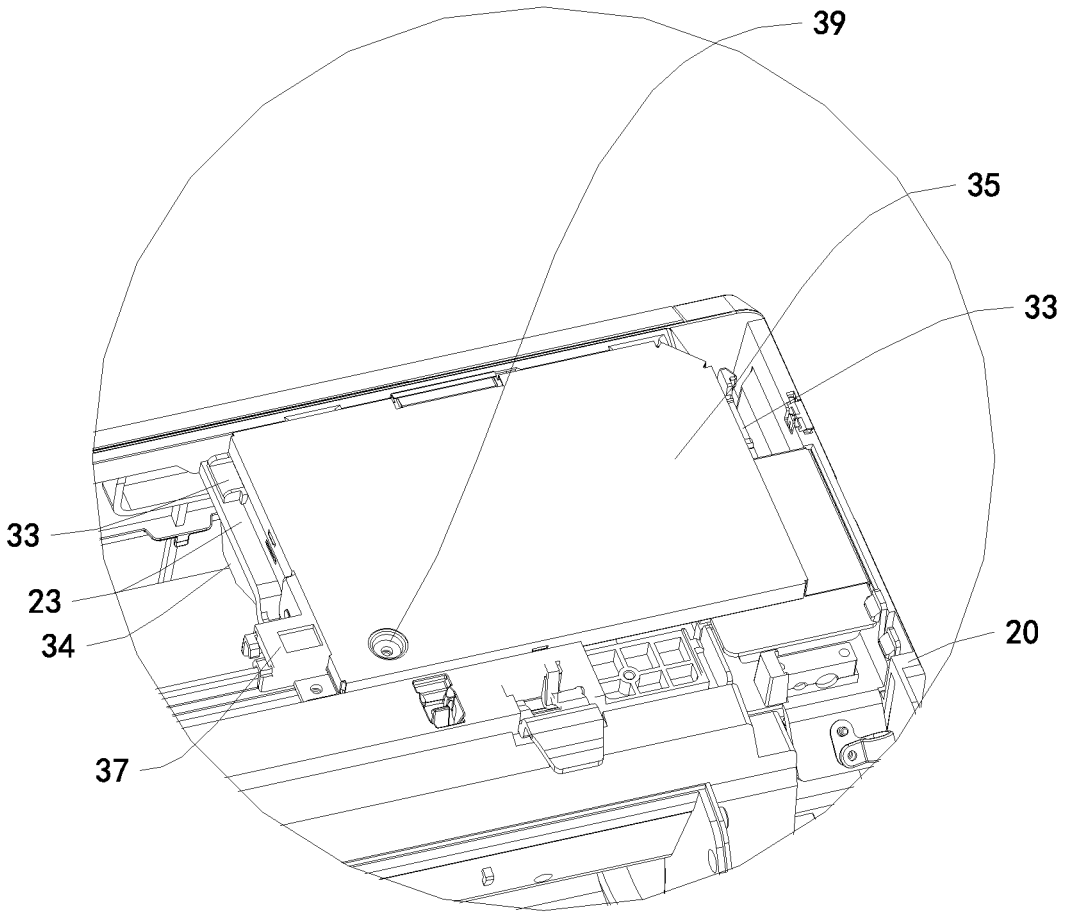
FIG. 8 is a schematic view showing connection relationship between an electric control box and a face frame according to an embodiment of the present application.

In some embodiments, as illustrated in FIGS. 1, 2 and 5, the face frame 20 has an overlapping groove 231 recessed rearwards, the electric control box 30 includes a wire passage part 37 internally having a wire passage groove 371, the wire passage groove 371 is in communication with an internal space of the electric control box 30, and the wire passage part 37 is embedded in the overlapping groove 231. The wire passage part 37 is embedded in the overlapping groove 231, thereby providing support for the electric control box 30. For instance, as illustrated in FIG. 8, a left side of the electric control box 30 is provided with the wire passage part 37, and the wire passage part 37 extends leftwards and into the overlapping groove 231. Thus, the electric control box 30 can be supported on an outer surface of the face frame 20, and the electric control box 30 can be further conveniently maintained.

Figure 12:
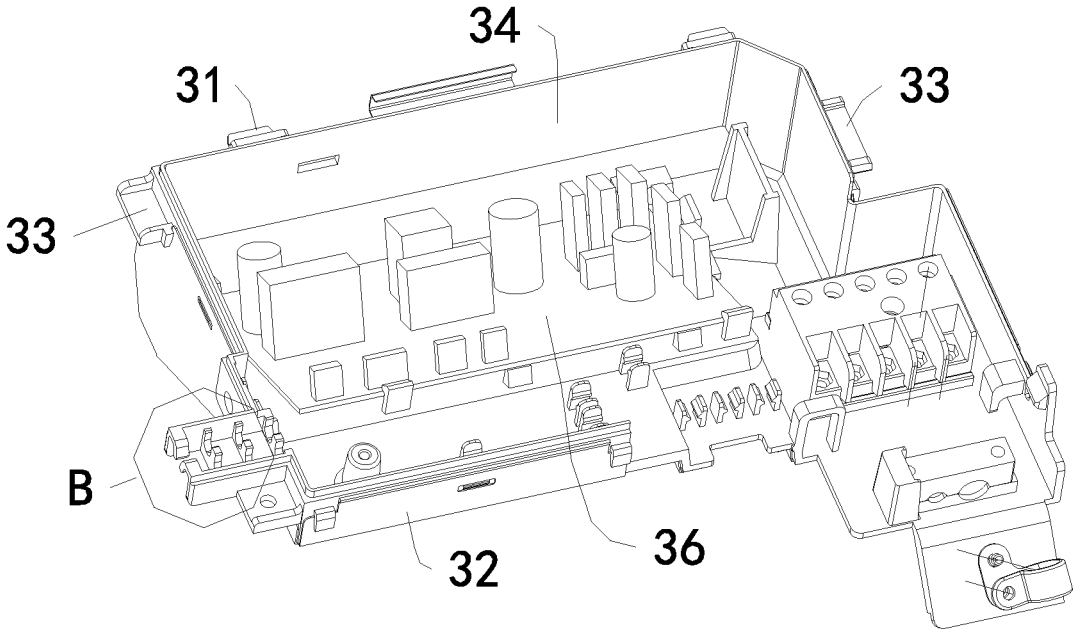
FIG. 12 is a schematic view showing connection relationship between a box body and an electric control board according to an embodiment of the present application.
Figure 13:
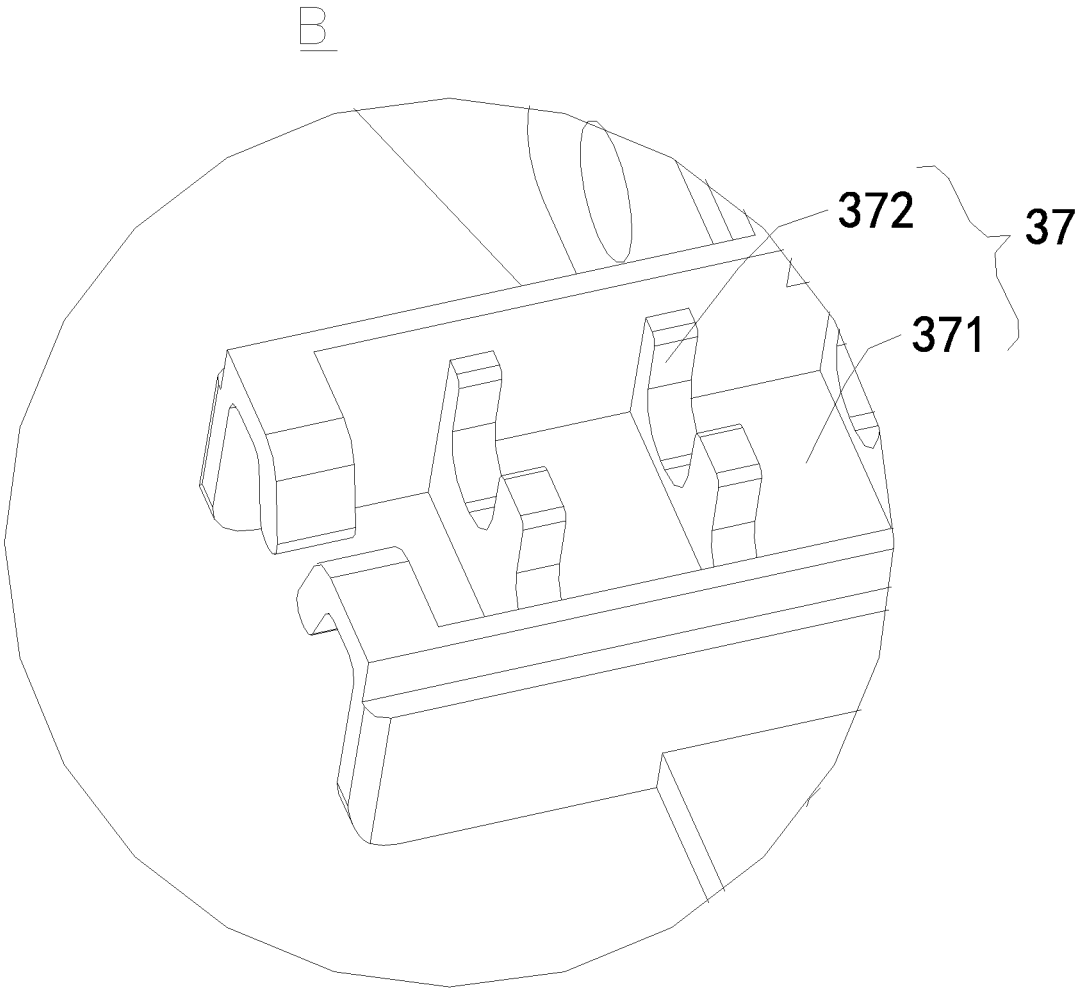
FIG. 13 is an enlarged view of a part B in FIG. 12.
Figure 14:
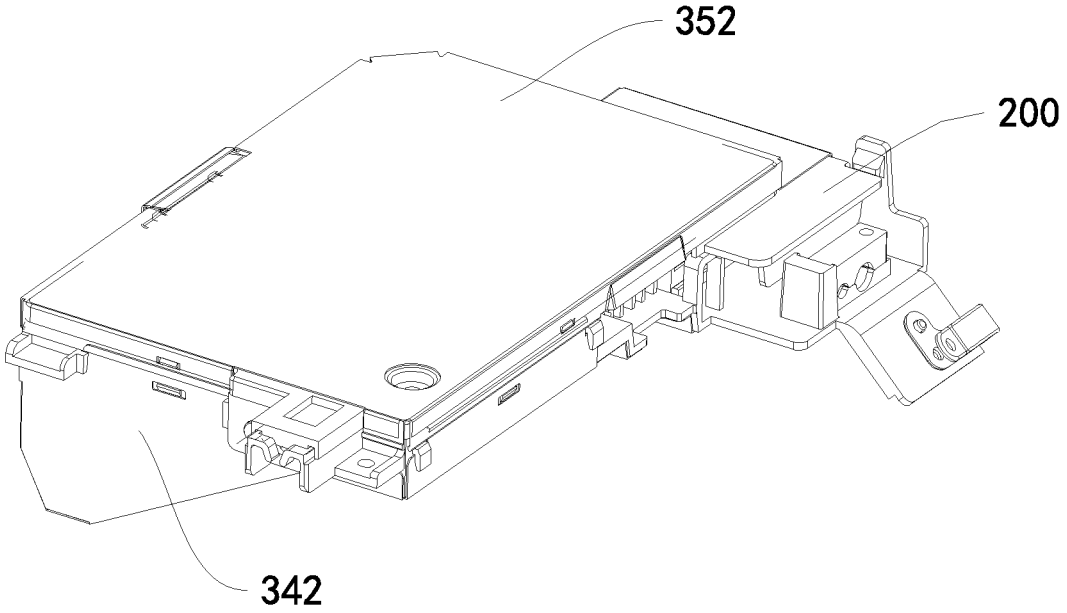
FIG. 14 is a schematic view of a structure of an electric control box according to some embodiments of the present application.

The wire passage groove 371 is used for wiring, in some specific embodiments, the wire passage part 37 is internally provided with a harness fixing structure, and the harness fixing structure is used to fix the harness. Further, as illustrated in FIGS. 12 and 13, the harness fixing structure is a plurality of ribs 372 spaced apart from one another in the left-and-right direction. Thus, the plurality of ribs 372 not only can fix the harness, but also has a sealing effect, thereby preventing the condensation water from entering the accommodating cavity through the wire passage part 37.

In some embodiments, as illustrated in FIGS. 1, 3 and 4, the panel 40 is hinged with the face frame 20. In other words, the panel 40 is rotatably connected to the face frame 20, and the panel 40 is rotatable to open and close the face frame 20. Thus, when the maintenance is needed, the panel 40 can be rotated and the electric control box 30 can be directly maintained, and the panel 40 can be rotated and restored after completion of the maintenance, thereby resulting in a simple operation and facilitating improvement of the maintenance efficiency.

In some embodiments, the electric control box 30 is detachably connected to the face frame 20; the face frame 20 is detachably connected to the chassis 10; the panel 40 is detachably connected to the face frame 20 or the panel 40 is turnable to open the face frame 20; the indoor heat exchanger 50 is detachably connected to the chassis 10; the electric control box 30 includes the box cover 35 and the box body 34; the box cover 35 is detachably connected to the box body 34; the box cover 35 includes the first inner housing 341 and the first sheet metal part 342, and the first inner housing 341 is detachably connected to the first sheet metal part 342; the box body 34 includes the second inner housing 351 and the second sheet metal part 352, and the second inner housing 351 is detachably connected to the second sheet metal part 352.

In one specific embodiment, as illustrated in FIGS. 1, 3 and 4, the electric control box 30 is located above the indoor heat exchanger 50. An accommodating space is formed between the face frame 20, the indoor heat exchanger 50 and the panel 40, and the electric control box 30 is located in the accommodating space. The electric control box 30 is mounted at the face frame 20, and the electric control box 30 is detachably connected to the face frame 20.

Figure 6:
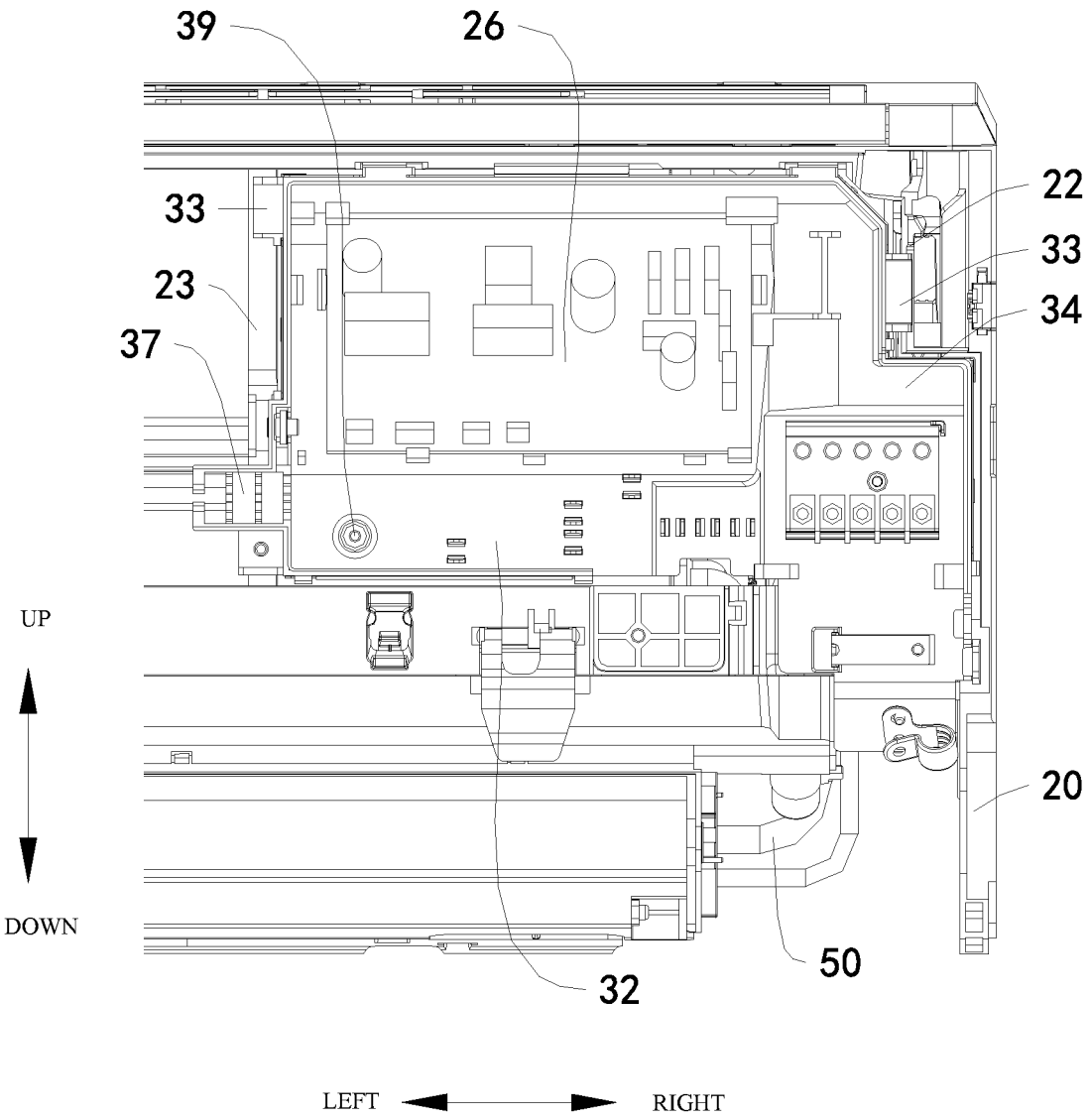
FIG. 6 is a schematic view of a partial structure of an air conditioner according to an embodiment of the present application.

As illustrated in FIGS. 1 and 5, an air-inlet grille 60 is connected to the face frame 20 and is integrally formed with the face frame 20, and the face frame 20 is provided with at least one insertion hole 21. The box body 34 is integrally formed, the upper end of the box body 34 is provided with at least one hook 31, and the hook 31 is provided with a guide bevel to cause the hook 31 to easily enter the insertion hole 21. The insertion hole 21 corresponds to the hook 31, so as to fix the electric control box 30 to the face frame 20. The face frame 20 includes a top plate, a right side of the top plate is provided with a support part, and the support part and the top plate are integrally formed. As illustrated in FIG. 5, the face frame 20 is provided with a support beam 23 at a left side of the electric control box 30, and the support beam and the top plate are integrally formed. The support part and the support beam 23 have pre-positioning effect, and can guide the mounting of the electric control box 30. As illustrated in FIG. 6, the corresponding structure of the electric control box 30 is the second overlapping part 33 and the wire passage part 37. The second overlapping part 33 and the wire passage part 37 are both connected to the box body 34, and are both integrally formed with the box body 34. As illustrated in FIG. 11, the box cover 35 and the box body 34 are detachably connected, and each have a structural form of sheet metals snapped to each other in the up-and-down direction. As illustrated in FIGS. 8 and 12, the box cover 35 is provided with a screw hole 39, the box body 34 is provided with a screw column 38 corresponding to the screw hole 39, and a screw can be connected to the box cover 35 and the box body 34 to seal the box body 34 and the box cover 35.

The electric control box 30 according to embodiments of the present application will be described below with reference to the drawings.

An electric control box of the related art, such as an electric control box for the air conditioner, is disposed in a dry environment and is not waterproof. However, when the electric control box is in a humid environment, moisture easily enters an interior of the electric control box, affects normal use of components and parts inside the electric control box, and easily causes damage of the components and parts, thereby affecting operational reliability and stability of the electric control box and affecting service life of the electric control box.

As illustrated in FIGS. 14 to 20, the electric control box 30 according to embodiments of the present application includes the first inner housing 341 and the second inner housing 351.

The inner housing 341 has an opening 202, and the first inner housing 341 has a first connection face 212. The second inner housing 351 and the first inner housing 341 are detachably connected to open and close the opening 202, and the second inner housing 351 has a second connection face 223 fitted to the first connection face 212. One of the first inner housing 341 and the second inner housing 351 has a water stop part 230 extending into the other thereof, and the water stop part 230 is located inside fitting place between the first connection face 212 and the second connection face 223.

In the electric control box 30 according to embodiments of the present application, the first inner housing 341 has the first connection face 212, and the second inner housing 351 has the second connection face 223 fitted to the first connection face 212. In this way, a contact fit between the first inner housing 341 and the second inner housing 351 can be realized by using the first connection face 212 and the second connection face 223, a large gap between the first inner housing 341 and the second inner housing 351 can be avoided, the probability that the moisture enters its interior through the gap between the first inner housing 341 and the second inner housing 351 can be reduced, sealing performance of the junction between the first inner housing 341 and the second inner housing 351 can be improved, and the waterproof performance of the electric control box 30 can be improved.

Furthermore, one of the first inner housing 341 and the second inner housing 351 has the water stop part 230 extending into the other thereof, and the water stop part 230 is located inside the fitting place between the first connection face 212 and the second connection face 223. In this way, the water stop part 230 can be used to obstruct the moisture, the probability that the moisture enters the interior of electric control box 30 can be reduced, the water stop part 230 can also be used to obstruct the moisture even if the moisture enters through the fitting place between the first connection face 212 and the second connection face 223, the moisture can be prevented from entering interiors of the first inner housing 341 and the second inner housing 351 through the opening 202, the waterproof performance of the electric control box 30 can be improved, the moisture can be prevented from entering which otherwise affects normal operation of the electric control box 30 and even causes damage of the electric control box 30, thereby facilitating improvement of the operational reliability and stability of the electric control box 30, the service life of the electric control box 30, and the functionality and applicability of the electric control box 30.

Therefore, the electric control box 30 according to embodiments of the present application has advantages of good waterproof effect, high reliability, etc.

The electric control box 30 according to specific embodiments of the present application will be described below with reference to the drawings.

In some specific embodiments of the present application, as illustrated in FIGS. 14 to 20, the electric control box 30 according to embodiments of the present application includes the first inner housing 341 and the second inner housing 351.

Figure 19:
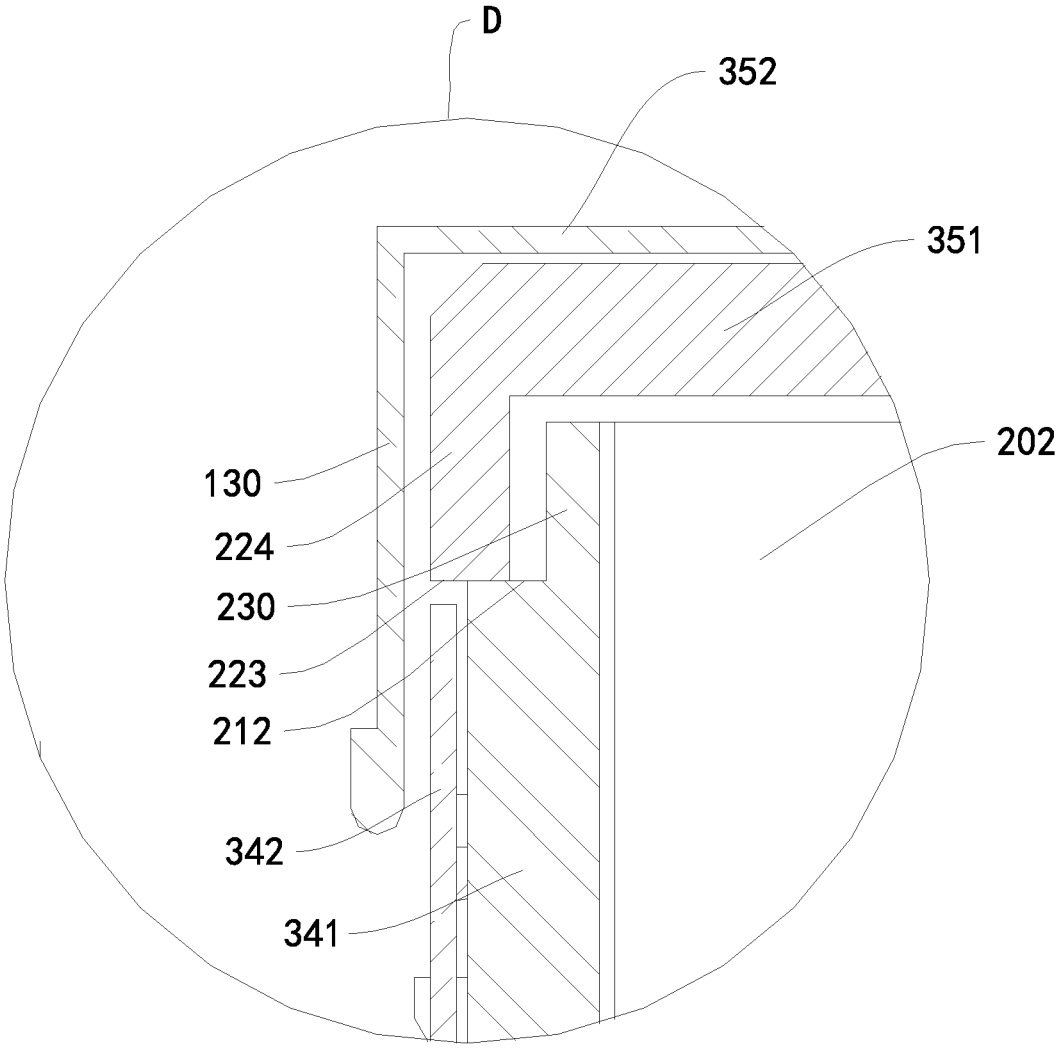
FIG. 19 is an enlarged view of a part D in FIG. 18.
Figure 20:
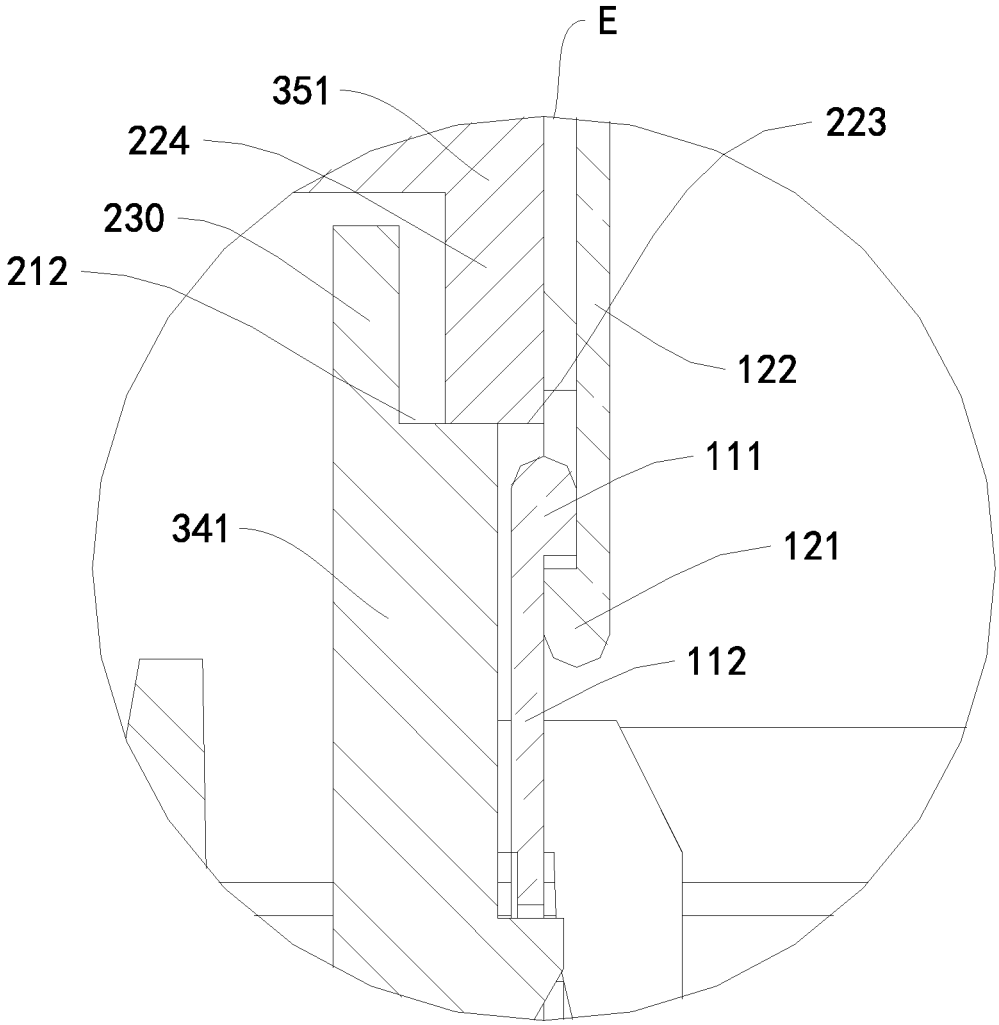
FIG. 20 is an enlarged view of a part E in FIG. 18.

Specifically, as illustrated in FIGS. 19 and 20, the first inner housing 341 has the water stop part 230 extending into the second inner housing 351, the second inner housing 351 has a flange part 224 extending towards the first inner housing 341, the water stop part 230 is disposed on an inner side of the flange part 224, and the water stop part 230 and the flange part 224 are arranged oppositely. In this way, not only assembling and forming of the first inner housing 341 and the second inner housing 351 are facilitated, but also the flange part 224 and the water stop part 230 together can be conveniently used to obstruct the moisture, thereby preventing the moisture from entering interiors of the first inner housing 341 and the second inner housing 351 and further improving the waterproof performance of the electric control box 30.

More specifically, an end face of the flange part 224 forms the second connection face 223. In this way, the formation of the second connection face 223 is facilitated, and the fitting and mounting of the first inner housing 341 and the second inner housing 351 are facilitated.

Optionally, the water stop part 30 is disposed adjacent to the opening 202, and the first connection face 212 is disposed at an outer side of the water stop part 230 and lower than an end face of the water stop part 230. In this way, the water stop part 230 is used to block out the moisture, thereby protecting the opening 202, preventing the moisture from entering interiors of the first inner housing 341 and the second inner housing 351 through the opening 202, and improving the waterproof performance of the electric control box 30.

Specifically, the flange part 224 and the water stop part 230 are spaced apart from each other. In this way, the flange part 224 is prevented from interfering with the water stop part 230, and the smooth mounting of the first inner housing 341 and the second inner housing 351 is facilitated.

Optionally, in an extending direction of the flange part 224, a length of an overlapping portion between the flange part 224 and the water stop part 230 is greater than or equal to 1 millimeter. In this way, the overlapping portion between the flange part 224 and the water stop part 230 is enabled to have an enough length, the flange part 224 and the water stop part 230 can be conveniently used to obstruct the moisture, and the waterproof performance of the electric control box 30 can be improved.

In some embodiments of the present application, the water stop part 230 is oriented in an extending direction of an edge of the opening 202. In this way, the opening 202 is conveniently and better protected by the water stop part 230, and the moisture is prevented from entering an interior of the opening 202.

In some specific embodiments of the present application, the opening 202 is formed in a front surface of the first inner housing 341, the second inner housing 351 is located in front of the first inner housing 341 and covers an outer side of the first inner housing 341, and the water stop part 230 is oriented in a horizontal direction.

Optionally, as illustrated in FIG. 11, the electric control box 30 further includes the first sheet metal part 342 and the second sheet metal part 352, the first sheet metal part 342 covers the outer side of the first inner housing 341 and is connected to the first inner housing 341. The second sheet metal part 352 covers the outer side of the second inner housing 351 and is connected to the second inner housing 351. The second sheet metal part 352 has the blocking part 130 extending towards the first sheet metal part 342, and the blocking part 130 extends beyond the fitting place between the first connection face 212 and the second connection face 223. In this way, not only the first sheet metal part 342 can be used to protect the first inner housing 341, the second sheet metal part 352 can be used to protect the second inner housing 351, but also the blocking part 130 can be used to shield the fitting place between the first connection face 212 and the second connection face 223, thereby preventing the moisture from entering the interior of the electric control box 30, further facilitating improvement of the waterproof performance of the electric control box 30, and improvement of the operational reliability and stability of the electric control box 30.

Further, the first inner housing 341 is fitted to the first sheet metal part 342 by snap-fit; and/or, the second inner housing 351 is fitted to the second sheet metal part 352 by snap-fit. In this way, mounting and dismounting of the first sheet metal part 342 and the first inner housing 341 as well as the second sheet metal part 352 and the second inner housing 351 is facilitated, connection strength and reliability between the first sheet metal part 342 and the first inner housing 31 is improved, and connection strength and reliability between the second sheet metal part 352 and the second inner housing 351 is improved.

Specifically, as illustrated in FIG. 11, one of the first inner housing 341 and the first sheet metal part 342 has a first snap 211, and the other thereof has a first snap hole 117 fitted to the first snap 211; and/or, one of the second inner housing 351 and the second sheet metal part 352 has a second snap 221, and the other thereof has a second snap hole 126 fitted to the second snap 221. In this way, the first snap 211 and the first snap hole 117 can be used to realize the snap-fit connection between the first sheet metal part 342 and the first inner housing 341, the second snap 221 and the second snap hole 126 can be used to realize the snap-fit connection between the second sheet metal part 352 and the second inner housing 351, the connection stability and reliability between the first inner housing 341 and the first sheet metal part 342 is improved, and the connection stability and reliability between the second inner housing 351 and the second sheet metal part 352 is improved.

More specifically, a plurality of first snaps 211 are provided and arranged in a circumferential direction of the electric control box 30, a plurality of second snap holes 126 are provided and arranged in the circumferential direction of the electric control box 30, and the first snaps 211 have a one-to-one correspondence with the first snap holes 117. A plurality of second snaps 221 are provided and arranged in the circumferential direction of the electric control box 30, a plurality of second snap holes 126 are provided and arranged in the circumferential direction of the electric control box 30, and the second snaps 221 have a one-to-one correspondence with the second snap holes 126. A size of the first snap 211 is greater than or equal to a size of the second snap 221, and an area of the first snap hole 117 is greater than or equal to an area of the second snap hole 126. In this way, the connection strength between the first sheet metal part 342 and the first inner housing 341 is conveniently improved to enable more uniform stress between the first sheet metal part 342 and the first inner housing 341, and the connection strength between the second sheet metal part 352 and the second inner housing 351 is conveniently improved to enable more uniform stress between the second sheet metal part 352 and the second inner housing 351.

Figure 17:
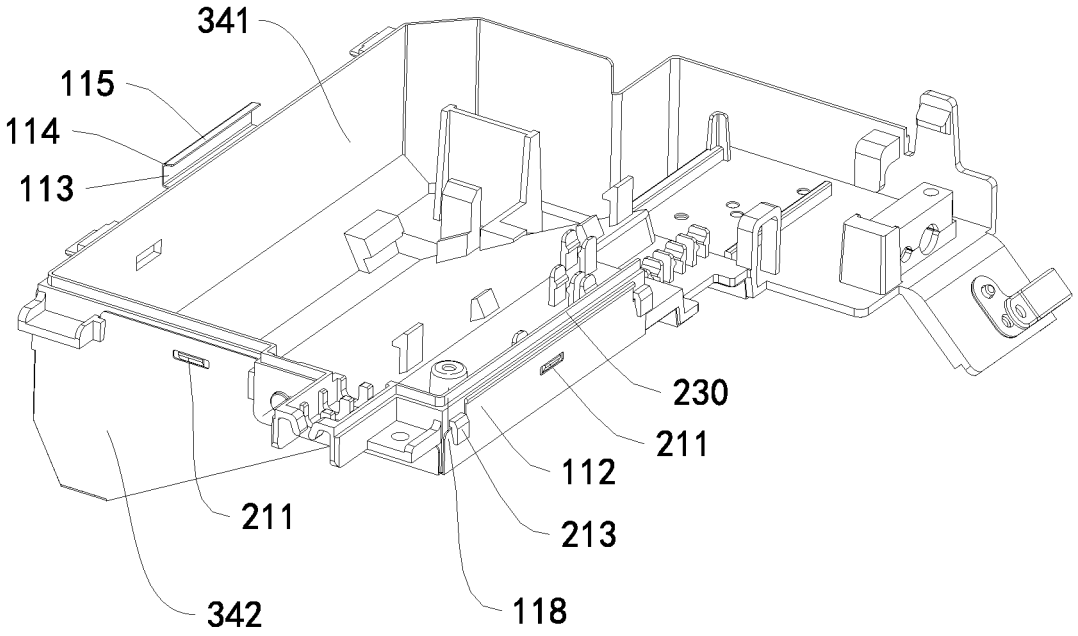
FIG. 17 is a schematic view of a structure of a box body of an electric control box according to some embodiments of the present application.

Optionally, as illustrated in FIG. 17, one of the first inner housing 341 and the first sheet metal part 342 has an first insertion groove 213, and the other thereof has a first insertion part 118 fitted to the first insertion groove 213 to cause the first sheet metal part 342 to be in tight contact with the first inner housing 341; and/or, one of the second inner housing 351 and the second sheet metal part 352 has a second insertion groove, and the other thereof has a second insertion part fitted to the second insertion groove to cause the second sheet metal part 352 to be in tight contact with the second inner housing 351. In this way, the tight contact and fitting between the first inner housing 341 and the first sheet metal part 342 can be conveniently achieved, the tight contact and fitting between the second inner housing 351 and the second sheet metal part 352 can be conveniently achieved, and assembling effect between the first inner housing 341 and the first sheet metal part 342 as well as between the second inner housing 351 and the second sheet metal part 352 is improved.

Specifically, the first sheet metal part 342 and the second sheet metal part 352 are made of metal materials. In this way, structural strength and connection reliability of the first sheet metal part 342 and the second sheet metal part 352 can be improved, and the first inner housing 341 and the second inner housing 351 can be conveniently protected.

More specifically, both the first sheet metal part 342 and the second sheet metal part 352 are sheet metal parts. In this way, not only production and machining of the first sheet metal part 342 and the second sheet metal part 352 are facilitated, and production efficiency of the first sheet metal part 342 and the second sheet metal part 352 are improved, but also enhancement of the structural strength of the first sheet metal part 342 and the second sheet metal part 352 are facilitated.

Further, an edge of the sheet metal part may undergo an edge folding process, an edge pressing process, etc. to prevent the sheet metal part from cutting a finger of a user hence wounding the user, during the user's operation.

Optionally, the first inner housing 341 and the second inner housing 351 are fireproof plastic members. Thicknesses of the first inner housing 341 and the second inner housing 351 are greater than or equal to 2.5 millimeters. The first sheet metal part 342 and the second sheet metal part 352 are sheet metal parts, and thicknesses of the first sheet metal part 342 and the second sheet metal part 352 are greater than or equal to 0.3 millimeter.

In some embodiments of the present application, the first sheet metal part 342 and the second sheet metal part 352 are connected by snap-fit. In this way, not only dismounting and mounting of the electric control box 30 are facilitated to improve assembling efficiency of the electric control box 30, but also enhancement of the connection strength and connection reliability between the first sheet metal part 342 and the second sheet metal part 352 are facilitated, and the first sheet metal part 342 and the second sheet metal part 352 are conveniently used to wrap a body part 200. Compared to the form of employing a plastic housing in the related art, the first sheet metal part 342 and the second sheet metal part 352 can effectively obstruct the fire when the interior of the electric control box 30 is on fire, the fire is isolated within the interior of the electric control box 30, and is prevented from coming out of the interior of the electric control box 30 after the plastic housing is burned out which may ignite other components. For example, when the electric control box 30 is disposed in the air conditioner 100, when the interior of the electric control box 30 is on fire, the fire can be prevented from coming out of the interior of the electric control box 30 which may ignite other components. Capability of the electric control box 30 to isolate the fire is conveniently improved, and the fire behavior can be controlled after the electric control box 30 is on fire, thereby improving use safety and reliability of the electric control box 30.

In some embodiments of the present application, the second sheet metal part 352 is provided with a first snap part, the first sheet metal part 342 is provided with a second snap part, and the first snap part is adapted to fit with the second snap part in a snap-fit manner. In this way, the first snap part and the second snap part can be used to realize snap fit between the second sheet metal part 352 and the first sheet metal part 342, which not only facilitates dismounting and mounting operations of the second sheet metal part 352 and the first sheet metal part 342, but also facilitates improvement of the connection strength between the second sheet metal part 352 and the first sheet metal part 342.

Specifically, as illustrated in FIG. 20, the first snap part includes a first snap protrusion 121, the second snap part includes a second snap protrusion 111, and the first snap protrusion 121 extends beyond the second snap protrusion 111 to be staggered with the second snap protrusion 111, thereby realizing interlock. In this way, the first snap protrusion 121 and the first snap protrusion 111 can be used to realize the reliable connection between the second sheet metal part 352 and the first sheet metal part 342, improve the connection strength and reliability between the second sheet metal part 352 and the first sheet metal part 342, and improve the structural stability of an outer casing 100.

Optionally, as illustrated in FIG. 20, the second sheet metal part 352 has a first flange 122 extending towards the first sheet metal part 342, the first sheet metal part 342 has a second flange 112 extending towards the second sheet metal part 352, and the first flange 122 and the second flange 112 are oppositely arranged. The first snap part is formed at the first flange 122 and extends in a length direction of the first flange 122, and the second snap part is formed at the second flange 112 and extends in a length direction of the second flange 112. In this way, the production and machining of the first snap part and the second snap part are facilitated, and smooth snap fit between the first snap part and the second snap part is facilitated.

Further, the first snap part is located at an outer edge of the first flange 122, and the second snap part is located at an outer edge of the second flange 112. In this way, the smooth fitting between the first snap part and the second snap part is further facilitated, and the assembling efficiency of the electric control box 30 is improved.

Optionally, the first snap part is formed by folding the outer edge of the first flange 122, and the second snap part is formed by folding the outer edge of the second flange 112. In this way, structures of the first snap part and the second snap part can be simplified, the production and machining of the first snap part and the second snap part is facilitated, massive production of the outer casing 100 is facilitated, production cost of the outer casing 100 is reduced, and the production efficiency of the outer casing 100 is improved.

It should be understood herein that, the whole outer edge of the second sheet metal part 352 is provided with the first flange 122, or at least a portion of the outer edge of the second sheet metal part 352 is provided with the first flange 122. The whole outer edge of the first sheet metal part 342 is provided with the second flange 112, or at least a portion of the outer edge of the first sheet metal part 342 is provided with the second flange 112.

In some embodiments of the present application, the second sheet metal part 352 is provided with a first insertion part, the first sheet metal part 342 is provided with a second insertion part, and the first insertion part is adapted to fit with the second insertion part in an insertion manner. In this way, the first insertion part and the second insertion part can be used to position and guide assembling of the second sheet metal part 352 and the first sheet metal part 342, smooth assembling and formation of the second sheet metal part 352 and the first sheet metal part 342 can be facilitated, the assembling efficiency of the outer casing 100 is improved, and assembling time of the outer casing 100 is shortened.

Figure 15:
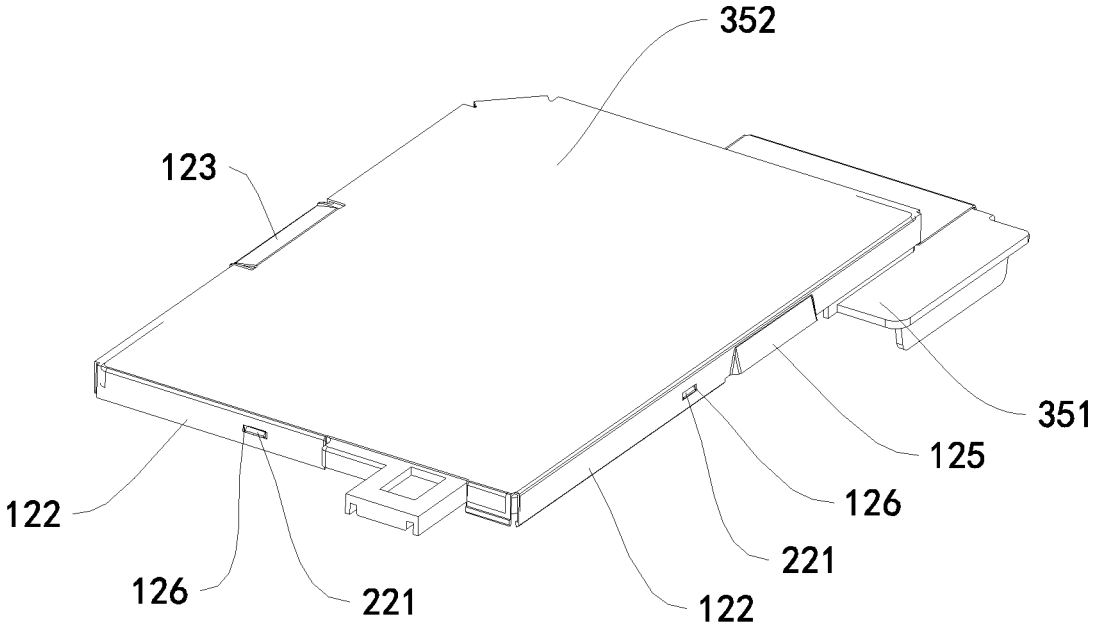
FIG. 15 is a schematic view of a structure of a box cover of an electric control box according to some embodiments of the present application.
Figure 16:
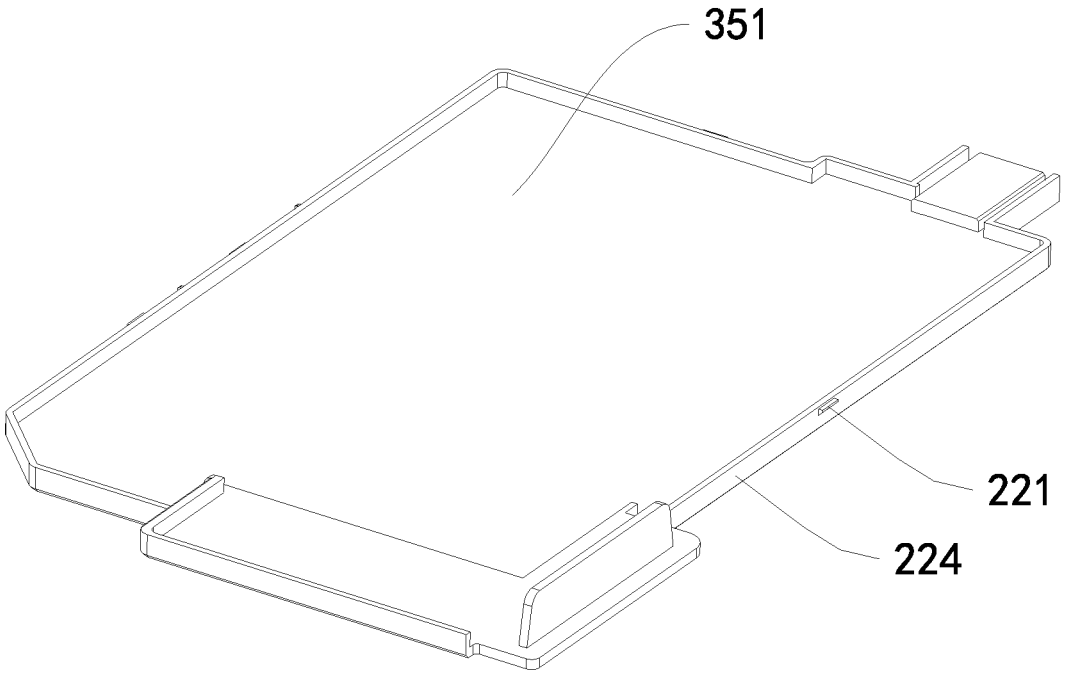
FIG. 16 is a schematic view of a structure of a second inner housing of an electric control box according to some embodiments of the present application.

According to some embodiments of the present application, as illustrated in FIGS. 15 and 17, the first insertion part has an insertion projection 123 protruding outwards, the second insertion part has an insertion groove 113, and a groove opening of the insertion groove 113 faces the insertion projection 123 to enable the insertion projection 123 to be inserted into the insertion groove 113. In this way, insertion fit between the insertion projection 123 and the insertion groove 113 is facilitated, and the assembling efficiency of the second sheet metal part 352 and the first sheet metal part 342 is further facilitated.

Optionally, the insertion projection 123 and the second sheet metal part 352 are integrally formed.

More specifically, the insertion projection 123 has a first guide face 124 adapted to be inserted into the insertion groove 113, and the insertion groove 113 has a second guide face 114 fitted to the first guide face 124. In this way, the first guide face 124 and the second guide face 114 can be used to position and guide insertion and mounting of the insertion projection 123, smooth insertion of the insertion projection 123 into the insertion groove 113 is facilitated, mounting of the second sheet metal part 352 and the first sheet metal part 342 can be more smooth, and the assembling and formation of the outer casing 100 is further facilitated.

Optionally, as illustrated in FIG. 17, an outer side wall of the first sheet metal part 342 is provided with a fixing sheet 115 protruding outwards, and the fixing sheet 115 includes the insertion groove 113. Further, the insertion groove 113 is formed by bending the fixing sheet 115. In this way, the machining and shaping of the insertion groove 113 is facilitated, the structural strength and reliability of the insertion groove 113 is facilitated, and improvement of the machining efficiency of the first sheet metal part 342 is facilitated at the same time.

Further, the fixing sheet 115 and the outer side wall of the first sheet metal part 342 are integrally formed.

Specifically, a junction between the insertion groove 113 and the outer side wall of the first sheet metal part 342 is provided with a reinforcing rib, and the reinforcing rib matches a shape of the insertion groove 113. Further, a plurality of reinforcing ribs are provided and spaced apart from one another in a length direction of the insertion groove 113. In this way, the structural strength and rigidity of the insertion groove 113 can be enhanced, production of a stress weak point of the insertion groove 113 is avoided, deformation and damage of the insertion groove 113 is prevented, and the fitting reliability between the insertion groove 13 and the insertion projection 123 is improved.

According to some other embodiments of the present application, the first insertion part has the insertion projection 123 protruding outwards, the second insertion part has the insertion hole, and the insertion hole faces the insertion projection 123 to enable the insertion projection 123 to be inserted into the insertion hole. The outer side wall of the first sheet metal part 342 is provided with a connecting sheet protruding outwards, and the connecting sheet includes the insertion hole. In this way, insertion fit between the insertion projection 123 and the insertion hole is facilitated, and the assembling efficiency of the second sheet metal part 352 and the first sheet metal part 342 is further facilitated.

Optionally, as illustrated in FIG. 15, an edge of the second sheet metal part 352 is provided with a handle 125. Further, the handle 125 is disposed at the first flange 122 and is arranged opposite the insertion projection 123. In this way, the user can pull the second sheet metal part 352 outwards through the handle 125, thereby facilitating realization offset and disengagement between the first snap protrusion 121 and the second snap protrusion 111, facilitating dismounting operation of the second sheet metal part 352 and the first sheet metal part 342, and improving dismounting efficiency of the outer casing 100.

Specifically, as illustrated in FIG. 11, the outer casing 100 is provided with a passage opening 101, and the body part 200 is in communication with the outside through the passage opening 101. In this way, an internal structure of the body part 200 can be connected to the outside by using the passage opening 101, and the electric control box 30 is conveniently connected to other structures.

Optionally, a surface of the first snap 211 is provided with a first-snap guide face adapted to be fitted to the first snap hole 117, and a surface of the second snap is provided with a second-snap guide face adapted to be fitted to the second snap hole. In this way, the first-snap guide face can be used to position and guide the mounting of the first snap 211, the second-snap guide face can be used to position and guide the mounting of the second snap 221, thereby facilitating smooth snapping between the first snap 211 and the first snap hole 117 as well as between the second snap 221 and the second snap hole 126.

In some embodiments of the present application, the first inner housing 341 is provided with a support bump adapted to support the first insertion part, the support bump is located at an inner side of the first insertion part, and the support bump extends in a length direction of the first insertion part. In this way, the support bump can be used to support the first insertion part, the deformation of the first insertion part is avoided, and improvement of the structural strength of the first insertion part is facilitated.

Specifically, the support bump is adapted to support the insertion projection 123, the support bump is located at an inner side of the insertion projection 123, and the support bump extends in a length direction of the insertion projection 123.

Optionally, two ends of the first insertion part in the length direction is provided with a limiting plate respectively, and the first insertion part is fitted between the two limiting plates. In this way, the limiting plate can be used to limit the first insertion part, large size displacement of the first insertion part in the length direction is avoided, and the improvement of the arrangement reliability of the first insertion part is further facilitated.

Further, two limiting plates are disposed at two ends of the support bump in a length direction thereof respectively, and the support bump is located between the two limiting plates.

Figure 18:
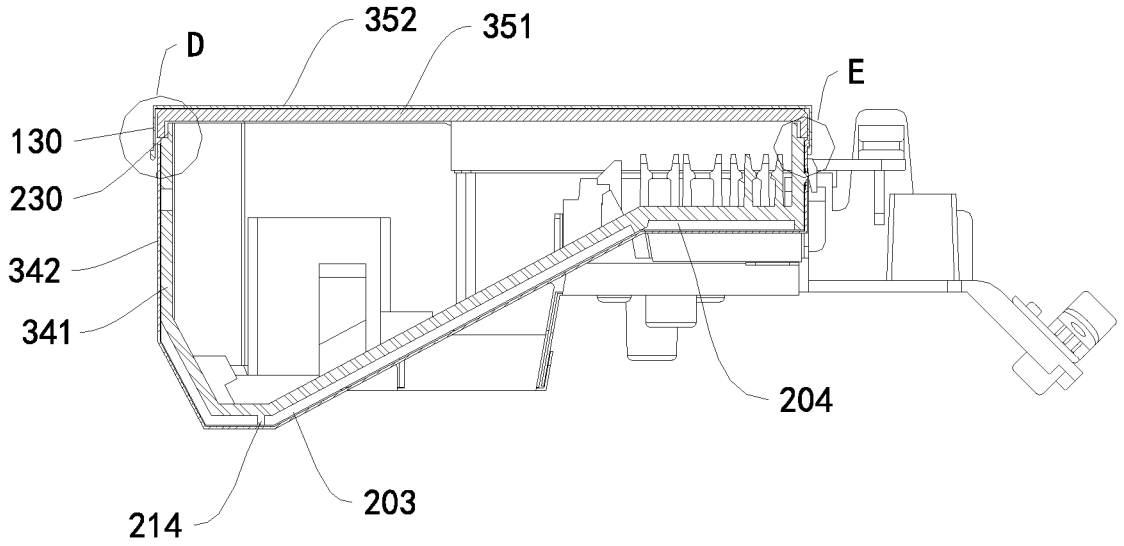
FIG. 18 is a sectional view of an electric control box according to some embodiments of the present application.

In some embodiments of the present application, as illustrated in FIG. 18, at least a portion of an outer surface of the body part 200 and an inner surface of the outer casing 100 are provided with an isolation gap 203 therebetween. At least one of the outer surface of the body part 200 and the inner surface of the outer casing 100 is provided with an isolation rib 214 configured to divide the isolation gap 203. In this way, a thermal insulation layer can be formed at the isolation gap. For example, air and thermal insulation material can be filled in the isolation gap 203. Thermal insulation performance of the electric control box 30 can be improved, formation of the condensation water inside the electric control box 30 in a case where the outside is cold and the inside is hot can be avoided, the operational reliability and stability of the electric control box 30 can be improved, and the service life of the electric control box 300 can be prolonged.

Furthermore, compared to a form in the related art that a thermal insulation material such as a sponge or the like is adhered to a surface of the electric control box assembly, the use of the thermal insulation material such as the sponge or the like can be reduced. Reduction of the production cost of the electric control box 30 is facilitated, and since the use of the sponge requires a certain thickness to realize thermal insulation effect, provision of the isolation gap 203 can avoid excessive occupied volume resulting from provision of the sponge thermal insulation layer, thereby facilitating control of an overall size of the electric control box 30. Meanwhile, the sponge can be prevented from not having a heat preservation effect due to water absorption which cause failure of the thermal insulation function, and the improvement of the reliability and stability of the thermal insulation function of the electric control box 30 can be facilitated.

Additionally, at least one of the outer surface of the body part 200 and the inner surface of the outer casing 100 is provided with the isolation rib 214 configured to divide the isolation gap 203. In this way, the isolation rib 214 can be used to divide the isolation gap 203, and the isolation gap 203 can be conveniently subdivided. For example, more separate small zones are formed at the isolation gap 203, the air in the plurality of small zones do not interfere with each other, formation of the stable air layer in the isolation gap 203 is facilitated, the probability that the air flows in the isolation gap 203 is reduced, the heat preservation and thermal insulation of the isolation gap 203 is more stable and reliable, and the heat preservation and thermal insulation effect of the isolation gap 203 is improved.

Specifically, the isolation rib 214 is disposed at one of the outer surface of the body part 200 and the inner surface of the outer casing 100, and a distance between the isolation rib 214 and the other of the outer surface of the body part 200 and the inner surface of the outer casing 100 is less than or equal to 0.3 millimeter. In this way, the distance between the isolation rib 214 and the other of the outer surface of the body part 200 and the inner surface of the outer casing 100 can be controlled within a certain range, the probability that the air flows in the isolation gap 203 is reduced, and the stability of the air layer can be prevented from being affected by an excessive distance.

More specifically, the isolation rib 214 is disposed at the outer surface of the body part 200, and a distance between the isolation rib 214 and the inner surface of the outer casing 100 is less than or equal to 0.3 millimeter.

Optionally, a plurality of isolation ribs 214 are provided, and the plurality of isolation ribs 214 divide the isolation gap 203 into a plurality of sub-zones 204. In this way, a plurality of stable air zones can be formed at the isolation gap 203, the air in the isolation gap 203 is prevented from flowing, and the heat insulation performance of the isolation gap 203 is improved.

In some embodiments of the present application, the isolation rib 214 includes a plurality of first isolation ribs spaced apart from one another in a width direction of the body part 200, and each first isolation rib extends in the length direction of the body part 200. In this way, the plurality of first isolation ribs can be used to divide the isolation gap 203 into the plurality of sub-zones 204 in the width direction of the body part 200, and the air in the isolation gap 203 can be prevented from flowing in the width direction of the body part 200.

Specifically, the isolation rib 214 includes a plurality of second isolation ribs spaced apart from one another in the length direction of the body part 200, and each second isolation rib extends in the width direction of the body part 200. In this way, the plurality of second isolation ribs 213 can be used to divide the isolation gap 203 into the plurality of sub-zones 204 in the length direction of the body part 200, and the air in the isolation gap 203 can be prevented from flowing in the length direction of the body part 200.

More specifically, the plurality of first isolation ribs and the plurality of second isolation ribs are arranged in a cross manner. In this way, the isolation gap 203 is conveniently divided into the plurality of separate sub-zones 204, the stability of the air in the isolation gap 203 is improved, and the heat preservation and thermal insulation effect of the isolation gap 203 is improved.

Optionally, a distance between the outer surface of the body part 200 and the inner surface of the outer casing 100 at the isolation gap 203 is greater than or equal to 0.5 millimeter. In this way, the isolation gap 203 can has a sufficient thickness, and the isolation gap 203 is ensured to have a sufficient thermal insulation effect.

Specifically, the isolation gap 203 is internally filled with the air or the thermal insulation material. In this way, the heat preservation and thermal insulation performance of the isolation gap 203 can be improved, and isolation of heat transfer process between the inner side and the outer side of the electric control box can be facilitated.

In some embodiments of the present application, an outer surface of the first inner housing 341 and an inner surface of a metal box 110 form at least a portion of the isolation gap 203. In this way, the formation of the isolation gap 203 is facilitated, improvement of the thermal insulation performance of the electric control box 30 is further facilitated, and the operational reliability and stability of the electric control box 30 is improved.

In one specific embodiment of the present application, the electric control box 30 includes the first inner housing 341 and the second inner housing 351. The inner housing 341 has the opening 202, and the first inner housing 341 has the first connection face 212. The second inner housing 351 and the first inner housing 341 are detachably connected to open and close the opening 202, the second inner housing 351 has the second connection face 223 fitted to the first connection face 212. The first inner housing 341 has the water stop part 230 extending into the second inner housing 351, the second inner housing 351 has the flange part 224 extending towards the first inner housing 341, the water stop part 230 is disposed on an inner side of the flange part 224, and the water stop part 230 and the flange part 224 are arranged oppositely.

The end face of the flange part 224 forms the second connection face 223. The water stop part 30 is disposed adjacent to the opening 202, and the first connection face 212 is disposed at an outer side of the water stop part 230 and lower than an end face of the water stop part 230. The flange part 224 and the water stop part 230 are spaced apart from each other. In the extending direction of the flange part 224, the length of overlapping portion between the flange part 224 and the water stop part 230 is greater than or equal to 1 millimeter. The water stop part 230 is oriented in the extending direction of the edge of the opening 202.

The electric control box 30 further includes the first sheet metal part 342 and the second sheet metal part 352, the first sheet metal part 342 covers the outer side of the first inner housing 341 and is connected to the first inner housing 341. The second sheet metal part 352 covers the outer side of the second inner housing 351 and is connected to the second inner housing 351. The second sheet metal part 352 has the blocking part 130 extending towards the first sheet metal part 342, and the blocking part 130 extends beyond the fitting place between the first connection face 212 and the second connection face 223.

The first inner housing 341 is fitted to the first sheet metal part 342 by snap-fit, and the second inner housing 351 is fitted to the second sheet metal part 352 by snap-fit. The first inner housing 341 has the first snap 211, and the first sheet metal part 342 has the first snap hole 117 fitted to the first snap 211. The second inner housing 351 has the second snap 221, and the second sheet metal part 352 has the second snap hole 126 fitted to the second snap 221. The plurality of first snaps 211 are provided and arranged in the circumferential direction of the electric control box 30, the plurality of second snap holes 126 are provided and arranged in the circumferential direction of the electric control box 30, and the first snaps 211 have the one-to-one correspondence with the first snap holes 117. A plurality of second snaps 221 are provided and arranged in the circumferential direction of the electric control box 30, a plurality of second snap holes 126 are provided and arranged in the circumferential direction of the electric control box 30, and the second snaps 221 have a one-to-one correspondence with the second snap holes 126. The size of the first snap 211 is greater than or equal to the size of the second snap 221, and the area of the first snap hole 117 is greater than or equal to the area of the second snap hole 126.

The first inner housing 341 has the first insertion groove 213, and the first sheet metal part 342 has the first insertion part 118 fitted to the first insertion groove 213 to cause the first sheet metal part 342 to be in tight contact with the first inner housing 341. The second inner housing 351 has the second insertion groove, and the second sheet metal part 352 has the second insertion part fitted to the second insertion groove to cause the second sheet metal part 352 to be in tight contact with the second inner housing 351.

The first sheet metal part 342 and the second sheet metal part 352 are made of metal materials and are sheet metal parts. The edge of the sheet metal part may undergo the edge folding process, the edge pressing process, etc. The first inner housing 341 and the second inner housing 351 are fireproof plastic members. Thicknesses of the first inner housing 341 and the second inner housing 351 are greater than or equal to 2.5 millimeters. The first sheet metal part 342 and the second sheet metal part 352 are sheet metal parts, and thicknesses of the first sheet metal part 342 and the second sheet metal part 352 are greater than or equal to 0.3 millimeter.

In the following, the air conditioner 100 according to embodiments of the present application will be described. The air conditioner 100 according to embodiments of the present application includes a housing 2, an indoor heat exchanger 3 and an indoor fan. The housing 2 is internally provided with a mounting cavity, the indoor heat exchanger 3 is disposed in the mounting cavity, and the indoor fan is disposed in the mounting cavity. The electric control box 30 according to the above-described embodiments of the present application is disposed in the mounting cavity and located at a shaft side of the indoor fan.

Specifically, the electric control box 30 is located at a side of the indoor heat exchanger 3, and a side of the electric control box 30 near the indoor heat exchanger 3 matches a shape of the indoor heat exchanger 3. In this way, not only the electric control box 30 can be prevented from interfering with the indoor heat exchanger 3, but also internal space of the electric control box 30 can be increased to the greatest extent, thereby facilitating improvement of structure rationality and compactness of the air conditioner 100, and improving utilization ratio of the internal space of the air conditioner 100.

Optionally, the electric control box 30 is located at an upper side of the indoor heat exchanger 3, the housing 2 includes the face frame and a seat, the face frame is detachably connected to the seat, the electric control box 30 is detachably disposed at the face frame, and the indoor heat exchanger 3 is detachably disposed at the seat. In this way, mounting and arrangement of the electric control box 30 and the indoor heat exchanger 3 is facilitated, and improvement of the assembling efficiency of the electric control box 30 and the indoor heat exchanger 3 is facilitated.

The air conditioner 100 according to embodiments of the present application, by using the electric control box 30 according to the above-described embodiments of the present application, has advantages of good waterproof effect, high reliability, etc.

Other constitutions and operations of the air conditioner 100 according to embodiments of the present application are well known by those skilled in the art, which will not be described in detail herein.

In addition, terms such as "first" and "second" are used herein for purposes of description and are not intended to indicate or imply relative importance or significance. Thus, the feature associated with "first" and "second" may comprise one or more of this feature. In the description of the present application, the term "a plurality of" means two or more than two, unless specified otherwise.

In the present application, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

Although explanatory embodiments have been shown and described, it would be appreciated by those skilled in the art that the above embodiments cannot be construed to limit the present application, and changes, alternatives, and modifications can be made in the embodiments without departing from spirit, principles and scope of the present application.

What is claimed is:

1. An air conditioner, comprising:

a chassis;

a face frame over the chassis;

an indoor heat exchanger disposed in a cavity formed by the chassis and the face frame;

an electric control box mounted at the face frame and located at a front portion of the face frame, at least a portion of the electric control box being detachably connected to the face frame; and a panel configured to openably cover the front portion of the face frame and the electric control box;

wherein at least a portion of the face frame is located between the indoor heat exchanger and the panel, and at least a portion of the electric control box is located between the portion of the face frame and the panel.

2. The air conditioner according to claim 1, wherein:

an upper end of the electric control box is inserted in an upper side of the front portion of the face frame; and a lower end of the electric control box includes an overlapping part overlapped at a front surface of a lower side of the front portion of the face frame, the overlapping part being detachably connected to the face frame.

3. The air conditioner according to claim 1, wherein the front portion of the face frame has an opening part, and at least a portion of the electric control box is detachably disposed in the opening part.

4. The air conditioner according to claim 1, wherein the electric control box includes:

a box body including an accommodating cavity having an open front portion and configured to accommodate an electric control board; and a box cover turnably or detachably connected to the box body and configured to openably cover an open side of the box body.

5. The air conditioner according to claim 4, wherein the box body or the box cover comprises:

a first inner housing; and a first sheet metal part undetachably or detachably connected to the first inner housing, and wrapping an outer side of the first inner housing.

6. The air conditioner according to claim 1, wherein the face frame is detachably connected to the chassis.

7. The air conditioner according to claim 1, wherein the panel is rotatably or turnably connected to the face frame.

8. The air conditioner according to claim 1, wherein:

the face frame has an overlapping groove recessed rearwards; and the electric control box comprises a wire passage part having a wire passage groove in communication with an internal space of the electric control box, the wire passage part being embedded in the overlapping groove.

9. The air conditioner according to claim 1, wherein the panel is hinged with the face frame.

10. The air conditioner according to claim 1, wherein:

the electric control box comprises:

a first inner housing having an opening and a first connection face; and a second inner housing detachably connected to the first inner housing to expose or cover the opening, the second inner housing having a second connection face matching the first connection face; and one of the first inner housing and the second inner housing includes a water stop part extending into another one of the first inner housing and the second inner housing, the water stop part being located inside a fitting place between the first connection face and the second connection face.

11. The air conditioner according to claim 10, wherein:

the second inner housing includes a flange part extending towards the first inner housing; and the water stop part is disposed on an inner side of the flange part and opposite the flange part.

12. The air conditioner according to claim 11, wherein the second connection face includes an end face of the flange part.

13. The air conditioner according to claim 11, wherein:

the water stop part is arranged adjacent to the opening; and the first connection face is disposed outside the water stop part and lower than an end face of the water stop part.

14. The air conditioner according to claim 10, wherein the water stop part is oriented in an extending direction of an edge of the opening.

15. The air conditioner according to claim 10, wherein:

the electric control box further comprises:

a first sheet metal part covering an outer side of the first inner housing and connected to the first inner housing; and a second sheet metal part covering an outer side of the second inner housing and connected to the second inner housing; and the second sheet metal part includes a blocking part extending towards the first sheet metal part and beyond a fitting place between the first connection face and the second connection face.

16. The air conditioner according to claim 15, wherein:

the first inner housing is fitted to the first sheet metal part by snap-fit; and/or the second inner housing is fitted to the second sheet metal part by snap-fit.

17. The air conditioner according to claim 15, wherein:

one of the first inner housing and the first sheet metal part includes a first snap, and another one of the first inner housing and the first sheet metal part includes a first snap hole fitted to the first snap; and/or one of the second inner housing and the second sheet metal part includes a second snap, and another one of the second inner housing and the second sheet metal part includes a second snap hole fitted to the second snap.

18. The air conditioner according to claim 15, wherein:

one of the first inner housing and the first sheet metal part includes a first insertion groove, and another one of the first inner housing and the first sheet metal part includes a first insertion part fitted to the first insertion groove to cause the first sheet metal part to be in tight contact with the first inner housing; and/or one of the second inner housing and the second sheet metal part has a second insertion groove, and another one of the second inner housing and the second sheet metal part includes a second insertion part fitted to the second insertion groove to cause the second sheet metal part to be in tight contact with the second inner housing.

19. The air conditioner according to claim 1, further comprising:

an indoor fan disposed in the cavity;

wherein the electric control box is located at a shaft side of the indoor fan.

20. The air conditioner according to claim 19, wherein the electric control box is located at a side of the indoor heat exchanger, and a side of the electric control box near the indoor heat exchanger matches a shape of the indoor heat exchanger.

* * * * *